US011617425B1

(12) United States Patent
Tashjian

(10) Patent No.: US 11,617,425 B1
(45) Date of Patent: Apr. 4, 2023

(54) JEWELRY PIECES AND METHODS OF MANUFACTURE AND USE THEREOF

(71) Applicant: Venus by Maria Tash, Inc., New York, NY (US)

(72) Inventor: Maria Tashjian, New York, NY (US)

(73) Assignee: Venus by Maria Tash, Inc., New York, NY (US)

( * ) Notice: Subject to any disclaimer, the term of this patent is extended or adjusted under 35 U.S.C. 154(b) by 0 days.

(21) Appl. No.: 17/861,118

(22) Filed: Jul. 8, 2022

(51) Int. Cl.
*A44C 5/00* (2006.01)
*A44C 7/00* (2006.01)
*A44C 9/00* (2006.01)

(52) U.S. Cl.
CPC ..... *A44C 7/002* (2013.01)

(58) Field of Classification Search
CPC ..... A44C 7/006; A44C 7/00; A44C 9/0046; A44C 5/00; A44C 5/0092
USPC ..... 63/7; D8/323, 327
See application file for complete search history.

(56) References Cited

U.S. PATENT DOCUMENTS 269,166 A * 12/1882 Bates ..... A44C 5/0092 63/7
798,879 A * 9/1905 Corrigan ..... A44C 5/0092 63/7
1,041,729 A * 10/1912 Bigney ..... A44C 5/0092 63/7
2,713,863 A * 7/1955 Handerson ..... A44C 7/00 134/169 R
6,125,657 A * 10/2000 Esposito ..... A44C 7/00 63/7
7,210,313 B1 * 5/2007 Kay ..... A44C 5/2019 63/3
D562,718 S * 2/2008 Wong ..... D11/40
7,602,303 B2 10/2009 Douglas et al.

OTHER PUBLICATIONS

Ganoksin, All About Hidden Hinges, downloaded from internet Jul. 8, 2022, https://www.ganoksin.com/article/all-about-hidden-hinges/ (8 pages).
Maria Tash, Hinge search, downloaded from internet Jul. 8, 2022, https://www.mariatash.com/shop.html?q=hinge (3 pages).

* cited by examiner

*Primary Examiner* — Jack W Lavinder
(74) *Attorney, Agent, or Firm* — Dentons US LLP

(57) ABSTRACT

Various pieces of jewelry and methods of manufacture and use thereof. In particular, these technologies enable a piece of jewelry with a region hosting (i) a hidden hinge and (ii) a decorative element. The decorative element includes a first wall and a second wall opposing the first wall such that the first wall and the second wall collectively define the decorative element when the hidden hinge is closed, thereby enabling a visually continuous appearance when viewed by an observer, and not collectively define the decorative element when the hidden hinge is open, thereby not enabling the visually continuous appearance when viewed by the observer. Therefore, by having the decorative element include the first wall and the second wall, the visually continuous appearance is enabled when the hidden hinge is closed.

24 Claims, 9 Drawing Sheets

JEWELRY PIECES AND METHODS OF MANUFACTURE AND USE THEREOF

TECHNICAL FIELD

This disclosure relates to jewelry pieces and methods of manufacture and use thereof.

BACKGROUND

A hidden hinge may be used in an earring. The earring may have a hinge region where the hidden hinge is located, with the hinge region being capable of movement to allow the hidden hinge to move (e.g., rotate) from an open position to a closed position and vice versa. This movement generally prevents or hinders any decorative elements (e.g., gemstones) that are located on adjacent regions of the earring from being located in the hinge region. Therefore, when the earring is worn by a wearer, this state of being generally prevents or hinders the earring from having a visually continuous appearance to an observer (e.g., a bystander), which is not desired by the wearer. As such, although the hidden hinge itself is hidden from being viewed by the observer, the hinge region is visible to the observer when the earring is worn by the wearer and is often apparent or obvious to the bystander due to lack of any decorative elements in the hinge region that are present on other regions of the earring. This presents an aesthetically discontinuous appearance to the earring, which is technologically problematic in showcasing the earring, either physically, such as in a physical store, where a potential customer has to bend down to more closely examine the earring, or virtually, such as in an electronic shopping platform where an image of the earring has to be expanded or zoomed in for a closer view. Additionally, the aesthetically discontinuous appearance is also aesthetically displeasing to the wearer of the earring. Furthermore, such state of being is also technologically problematic when the earring is manufactured because the hinge region would need to be skipped over to deposit the decorative elements, thereby delaying or slowing down the earring from being manufactured. Likewise, such state of being is also technologically problematic for a jeweler to design the earring to have a decorative element in the hinge region that has two or more distinct optical properties (e.g., reflectivity, luster).

SUMMARY

Generally, this disclosure enables various pieces of jewelry (e.g., earrings, bracelets, anklets, charms, pendants, bracelets) and methods of manufacture and use thereof. In particular, these technologies enable a piece of jewelry (e.g., an earring, a bracelet, an anklet, a charm, a pendant, a bracelet) with a region hosting (i) a hidden hinge (e.g., a knuckle hinge, a 2-knuckle hinge, a 3-knuckle hinge) and (ii) a decorative element. The decorative element includes a first wall (e.g., a gemstone) and a second wall (e.g., a gemstone) opposing the first wall such that the first wall and the second wall collectively define the decorative element when the hidden hinge is closed, thereby enabling a visually continuous appearance when viewed by an observer, and not collectively define the decorative element when the hidden hinge is open, thereby not enabling the visually continuous appearance when viewed by the observer. Therefore, by having the decorative element include the first wall and the second wall, the visually continuous appearance is enabled when the hidden hinge is closed.

In an embodiment, a device comprises: a first arcuate segment having a first outer side and a first inner side; a second arcuate segment having a second outer side and a second inner side; a pivot joining the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position; a first wall radially disposed on the first outer side such that the pivot extends between the first inner side and the first wall, wherein the first wall includes a first peak; a second wall radially disposed on the second outer side such that the pivot extends between the second inner side and the second wall, wherein the second wall includes a second peak, and wherein the first wall and the second wall oppose each other when the first peak and the second peak are coaligned with each other in the first position and the third position such that the first wall and the second wall collectively form a decorative element, wherein the first wall is offset with the second wall when the first peak and the second peak are not coaligned with each other in the second position and the fourth position such that the first wall and the second wall do not collectively form the decorative element.

In certain embodiments, the decorative element is a first decorative element, and the device further comprises: a second decorative element radially disposed on the first outer side; and a third decorative element radially disposed on the second outer side, wherein the first decorative element is interposed between the second decorative element and the third decorative element such that a decorative pattern is sequentially formed. In some embodiments, the first decorative element is at least partially pyramidal. In other embodiments, the second decorative element is at least partially conical and the third decorative element is at least partially conical. In yet other embodiments, at least one of the second decorative element or the third decorative element is at least partially a gemstone. In still other embodiments, the first arcuate segment and the second arcuate segment at least partially define an earring.

In additional embodiments, the device further comprises a third wall radially disposed on the first outer side such that the pivot extends between the first inner side and the third wall, wherein the third wall includes a third peak, and wherein the second wall is interposed between the first wall and the third wall when the first peak, the second peak, and the third peak are coaligned with each other in the first position and the third position such that the first wall, the second wall, and the third wall further collectively form the decorative element, wherein the third wall is offset with the second wall when the third peak and the second peak are not coaligned with each other in the second position and the fourth position such that the third wall or the first wall and the second wall do not further collectively form the decorative element. In further embodiments, the decorative element is at least partially a pyramid. In yet further embodiments, the pivot is a pin engaging the first arcuate segment and the second arcuate segment. In still further embodiments, the pivot includes a horn engaging the first arcuate segment and the second arcuate segment. In particular embodiments, the first arcuate segment includes a first material, wherein the second arcuate segment includes a second material, wherein the decorative element includes a third material, wherein the third material is different from at least one of the first material or the second material. In certain embodiments, the first material and the second material are one material. In some embodiments, the 3-shape is symmetrical. In other embodiments, the 3-shape is asymmetrical.

In an embodiment, a method comprises: accessing a device including a first arcuate segment, a second arcuate segment, a pivot, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; opening the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form a decorative element; and closing the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form the decorative element.

In an embodiment, a method comprises: accessing a device including a first arcuate segment, a second arcuate segment, a pivot, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; closing the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form a decorative element; and opening the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form the decorative element.

In an embodiment, a method comprises: accessing a device including a first arcuate segment, a second arcuate segment, a pivot, a first wall, a second wall, and a third wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; wherein the third wall is radially disposed on the first outer side such that the pivot extends between the first inner side and the third wall, wherein the third wall includes a third peak; opening the device based on moving the first arcuate segment about the pivot relative to the second arcuate segment from the first position to the second position or the second arcuate segment about the pivot relative to the first arcuate segment from the third position to the fourth position such that the first wall and third wall are offset with the second wall when the first peak and third peak are not coaligned with the second peak in the second position and the fourth position such that the first wall, the second wall and the third wall do not collectively form a decorative element; and closing the device based on moving the first arcuate segment about the pivot relative to the second arcuate segment from the second position to the first position or the second arcuate segment about the pivot relative to the first arcuate segment from the fourth position to the third position such that the first wall and third wall oppose the second wall when the first peak, the second peak and the third peak are coaligned with each other in the first position and the third position such that the first wall, the second wall and the third wall collectively form the decorative element.

In an embodiment, a method comprises: accessing a device including a first arcuate segment, a second arcuate segment, a pivot, a first wall, a second wall, and a third wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; wherein the third wall is radially disposed on the first outer side such that the pivot extends between the first inner side and the third wall, wherein the third wall includes a third peak, closing the device based on moving the first arcuate segment about the pivot relative to the second arcuate segment from the second position to the first position or the second arcuate segment about the pivot relative to the first arcuate segment from the fourth position to the third position such that the first wall and the third wall oppose the second wall when the first peak, the second peak and the third peak are coaligned with each other in the first position and the third position such that the first wall, the second wall and the third wall collectively form a decorative element; and opening the device based on moving the first arcuate segment about the pivot relative to the second arcuate segment from the first position to the second position or the second arcuate segment about the pivot relative to the first arcuate segment from the third position to the fourth position such that the first wall and third wall are offset with the second wall when the first peak and the third peak are not coaligned with the second peak in the second position and the fourth position such that the first wall, the second wall and the third wall do not collectively form the decorative element.

In an embodiment, a method comprises: supplying a device to an end user, wherein the device includes a first arcuate segment, a second arcuate segment, a pivot, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; and instructing the end user to: open the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form a decorative element; and close the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form the decorative element.

In an embodiment, a method comprises: supplying a device to an end user, wherein the device includes a first arcuate segment, a second arcuate segment, a pivot, a first wall, a second wall and a third wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first arcuate segment and the second arcuate segment collectively form a C-shape in the first position and the third position, wherein the first arcuate segment and the second arcuate segment collectively form a 3-shape in the second position and the fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak; wherein the third wall is radially disposed on the first outer side such that the pivot extends between the first inner side and the third wall, wherein the third wall includes a third peak, and instructing the end user to: open the device based on moving the first arcuate segment about the pivot relative to the second arcuate segment from the first position to the second position or the second arcuate segment about the pivot relative to the first arcuate segment from the third position to the fourth position such that the first wall and the third wall are offset with the second wall when the first peak and the third peak are not coaligned with the second peak in the second position and the fourth position such that the first wall, the second wall and the third wall do not collectively form a decorative element; and close the device based on moving the first arcuate segment about the pivot relative to the second arcuate segment from the second position to the first position or the second arcuate segment about the pivot relative to the first arcuate segment from the fourth position to the third position such that the first wall, the third wall and the second wall oppose each other when the first peak, the second peak and the third peak are coaligned with each other in the first position and the third position such that the first wall, the second wall and the third wall collectively form the decorative element.

DETAILED DESCRIPTION

Figure 1:
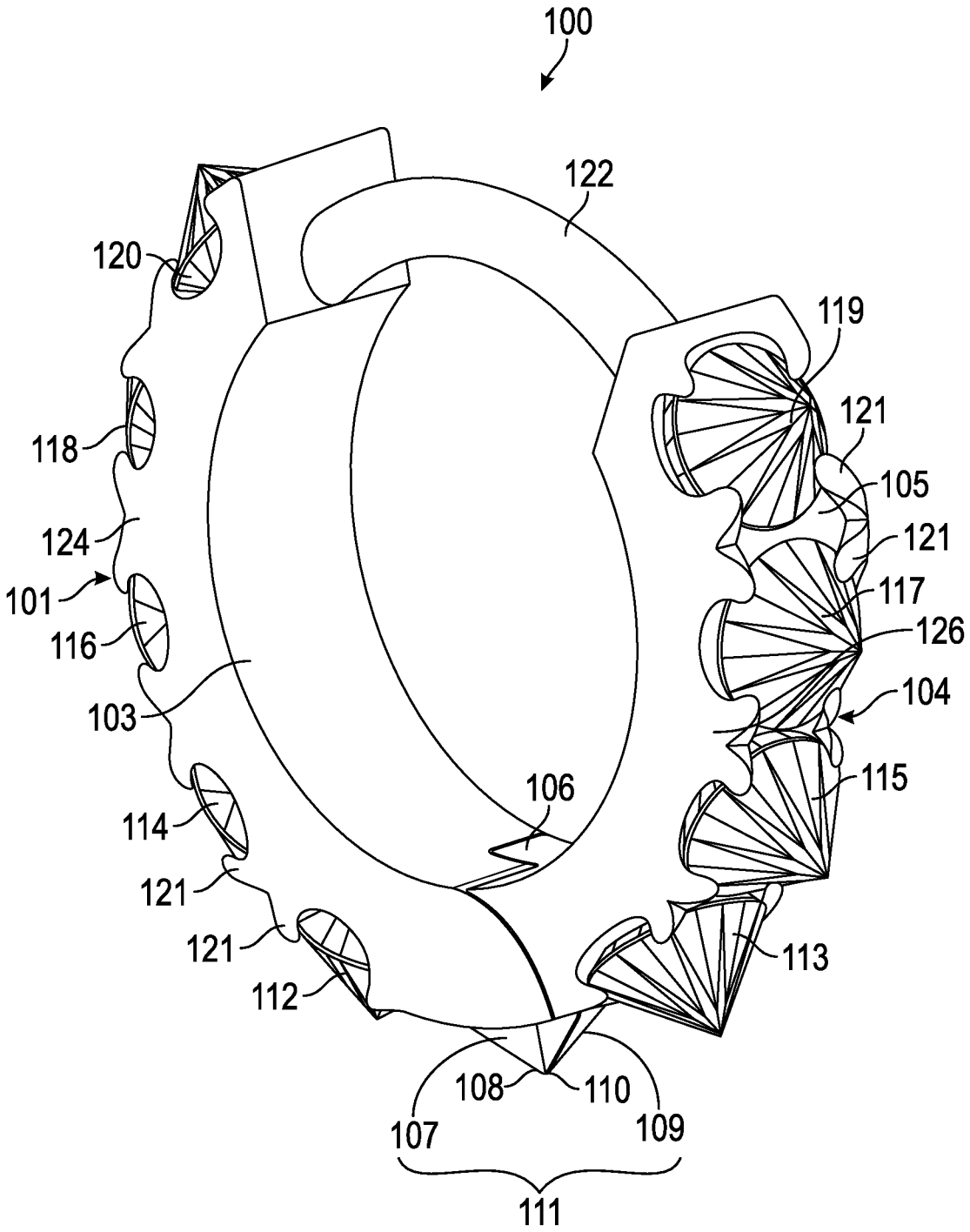
FIG. 1 is a perspective view of an embodiment of an earring with a two piece decorative element in a closed position according to this disclosure.

Generally, this disclosure enables various pieces of jewelry (e.g., earrings, bracelets, anklets, charms, pendants, bracelets) and methods of manufacture and use thereof. In particular, these technologies enable a piece of jewelry (e.g., an earring, a bracelet, an anklet, a charm, a pendant, a bracelet) with a region hosting (i) a hidden hinge (e.g., a knuckle hinge, a 2-knuckle hinge, a 3-knuckle hinge) and (ii) a decorative element. The decorative element includes a first wall (e.g., a gemstone) and a second wall (e.g., a gemstone) opposing the first wall such that the first wall and the second wall collectively define the decorative element when the hidden hinge is closed, thereby enabling a visually continuous appearance when viewed by an observer, and not collectively define the decorative element when the hidden hinge is open, thereby not enabling the visually continuous appearance when viewed by the observer. Therefore, by having the decorative element include the first wall and the second wall, the visually continuous appearance is enabled when the hidden hinge is closed.

This configuration is technologically beneficial in various scenarios. For example, when the piece of jewelry is an earring, then, in showcasing the earring, either physically, such as in a physical store, enables a potential customer to avoid bending down to more closely examine the earring, or virtually, such as in an electronic shopping platform, enables a viewer of an image of the earring to avoid having the image being expanded or zoomed in for a closer view. Additionally, the visually continuous appearance may avoid being aesthetically displeasing to a wearer of the earring. Furthermore, when the earring with the hinge region is being manufactured, the hinge region may avoid being skipped over to deposit the decorative elements, thereby minimizing delaying or slowing down the earring in being manufactured. Likewise, a jeweler is now enabled to design the earring to have the decorative element in the region to have two or more distinct optical properties (e.g., reflectivity, luster) when the first wall and the second wall have distinct optical properties (e.g., optically different from each other in color, reflectivity, luster). Similar technological benefits apply when the piece of jewelry is a bracelet, an anklet, a charm, a pendant, or another suitable piece of jewelry or device.

Note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans. The drawings illustrate example embodiments and are not to be construed as necessarily limiting this disclosure. Like numbers or similar numbering schemes can refer to like or similar elements throughout.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms (e.g., two, three, four, five, six, seven, eight, nine, ten, tens, hundreds, thousands) as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," "upper," "left" and "right" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below. Similarly, if a device in one of illustrative figures were turned over, then various elements described as "left" or "right" of other elements would then be oriented "right" or "left" of the other elements.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control (CNC) routing, milling, pressing, stamping, vacuum forming, hydroforming, injection molding, lithography, carving, chiseling, and so forth.

FIG. 1 illustrates a perspective view of an embodiment of an earring with a two piece decorative element in the closed position according to this disclosure. As shown in FIG. 1, an earring 100 includes a first arcuate segment 101 and a second arcuate segment 104.

The first arcuate segment 101 includes a first outer side, a first inner side 103, a left side 124 and a right side. The second arcuate segment 104 includes a second outer side 105, a second inner side 106, a first left side and a first right side. The first left side 124 extends from the first outer side or the first inner side 103. For example, the first left side or the first right side may span between the first outer side and the first inner side 103. The second left side and the second right side extends from the second outer side 105 or the second inner side 106. For example, the second left side or the second right side may span between the second outer side 105 and the second inner side 106.

The earring 100 includes a pivot joining the first arcuate segment 101 and the second arcuate segment 104 such that the first arcuate segment 101 is configured to move about the pivot relative to the second arcuate segment 104 between a first position (e.g., closed) and a second position (e.g., open) or the second arcuate segment 104 is configured to move about the pivot relative to the first arcuate segment 101 between a third position (e.g., closed) and a fourth position (e.g., open). The first arcuate segment 101 and the second arcuate segment 104 collectively form a C-shape in the first position and the third position (as shown in FIG. 1, when the earring 100 is closed). The first arcuate segment 101 and the second arcuate segment 104 collectively form a 3-shape in the second position and the fourth position (as shown in FIG. 3B when the earring 100 is open). The 3-shape may include an M-shape, a W-shape, or another suitable 3-shape.

The earring 100 includes a first wall 107 (e.g., a gemstone) radially disposed on the first outer side (e.g., monolithically, assembled) such that the pivot extends (e.g., longitudinally) between the first inner side 103 and the first wall 107. The first wall 107 includes a first peak 108. The first wall 107 is solid, but can solid, perforated, faceted, dimpled, or structured in other suitable ways. For example, the first wall 107 can be at least partially or totally a gemstone, whether precious or semi-precious, whether natural or synthetic, diamond, stone, glass, metal, alloy, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones.

The earring 100 includes a second wall 109 (e.g., a gemstone) radially disposed on the second outer side 105 (e.g., monolithically, assembled) such that the pivot extends (e.g., longitudinally) between the second inner side 106 and the second wall 109. The second wall 109 includes a second peak 110. The second wall 109 is solid, but can solid, perforated, faceted, dimpled, or structured in other suitable ways. The first wall 107 can have a first optical property (e.g., color, reflectivity, luster) and the second wall 109 can have a second optical property (e.g., color, reflectivity, luster). The first optical property can be identical to the second optical property. For example, the first wall 107 and the second wall 109 can collectively present a single optical appearance. The first optical property can be different from the second optical property. For example, the first wall 107 and the second wall 109 can avoid collectively presenting a single optical appearance. For example, the second wall 109 can be at least partially or totally a gemstone, whether precious or semi-precious, whether natural or synthetic, diamond, stone, glass, metal, alloy, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones.

The first wall 107 and the second wall 109 oppose each other when the first peak 108 and the second peak 110 are coaligned with each other in the first position and the third position (as shown to be closed in FIG. 1) such that the first wall 107 and the second wall 109 collectively form a decorative element 111. The first wall 107 is offset (e.g., positionally) with the second wall 109 when the first peak 108 and the second peak 110 are not coaligned with each other in the second position and the fourth position (as shown to be open in FIG. 3B) such that the first wall 107 and the second wall 109 do not collectively form the decorative element.

Figure 2A:
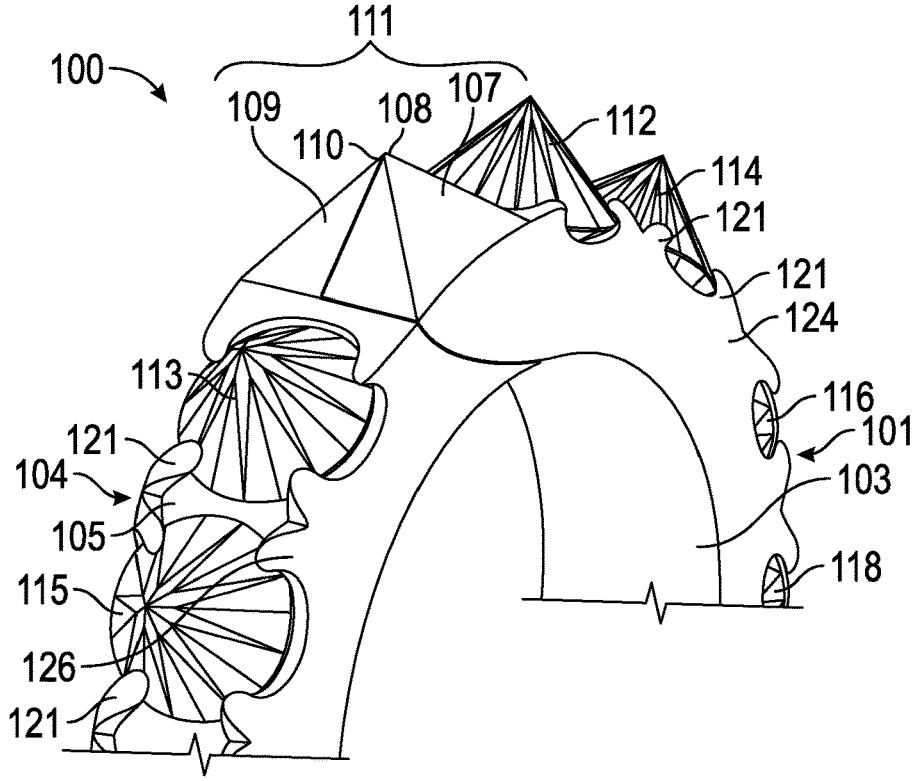
FIG. 2A is a perspective sectional view of an embodiment of an earring with a two piece decorative element in a closed position according to this disclosure.
Figure 2B:
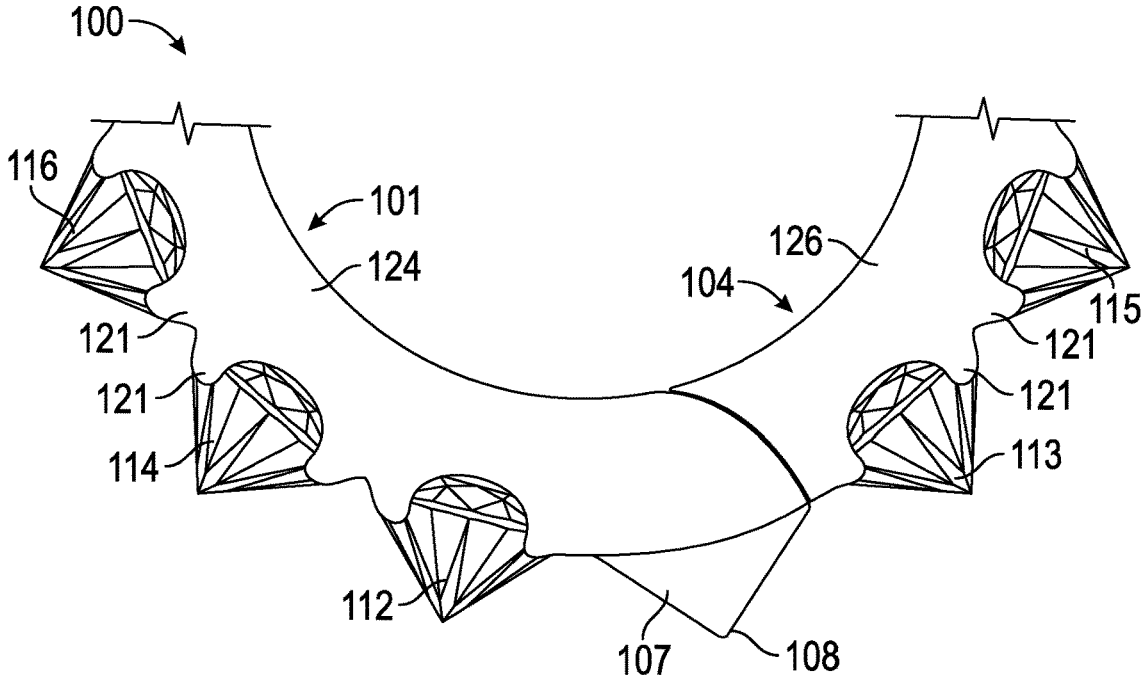
FIG. 2B is a sectional profile view of an embodiment of an earring with a two piece decorative element in a closed position according to this disclosure.

In the earring 100 depicted in FIG. 1, FIG. 2A and FIG. 2B, the decorative element 111 can be a first decorative element, and also shown are a second decorative element 112, a third decorative element 113, a fourth decorative element 114, a fifth decorative element 115, a sixth decorative element 116, a seventh decorative element 117, an eighth decorative element 118, a ninth decorative element 119, and a tenth decorative element 120, which may or may not be identical to each other in structure, shape, size, properties, or function. However in other embodiments, the earring 100 can have more of such decorative elements or less of such decorative elements or other decorative elements, and as such can have any suitable number of decorative elements, whether decoratively identical or non-identical to each other. These decorative elements can collectively form a sequential decorative pattern (e.g., arcuately disposed), as shown in FIG. 1, to visually blend with the decorative element 111 such that the decorative element 111 is not readily visually distinguishable from other decorative elements forming the sequential decorative pattern when the decorative element 111 is included in the sequential decorative pattern among other decorative elements in the sequential decorative pattern, whether being interposed between two decorative elements or being an ending decorative element in the sequential decorative pattern. Note that other decorative patterns may be formed (e.g., a geometrical pattern, a linear pattern, a rectilinear pattern, a sinusoidal pattern, a zigzag pattern, a polygonal pattern, an oval pattern, a circular pattern, a closed-shape pattern, an open-shape pattern, a character pattern, a star pattern, an animal pattern, a natural phenomenon pattern, a planetary pattern), whether additionally or alternatively, whether alone, integrated with, parallel, or intersecting with other decorative patterns.

As shown in FIG. 1, the decorative element 111 is at least generally pyramidal in shape, as collectively defined via the first wall 107 and the second wall 109 when the first arcuate segment 101 and the second arcuate segment 104 are positioned in the first position or the third position (e.g., closed). Although depicted as a four-sided pyramid, other configurations are possible, such as a three-sided pyramid. Additionally, the decorative element 111 can have other shapes, including, but not limited to, generally domed, generally semi-circular, generally square or rectangular, or generally parabolic, and can be symmetrical or asymmetrical, along a single plane or multiple planes. As shown in FIG. 1-FIG. 4, the additional decorative elements (the second decorative element 112, the third decorative element 113, the fourth decorative element 114, the fifth decorative element 115, the sixth decorative element 116, the seventh decorative element 117, the eighth decorative element 118, the ninth decorative element 119, and the tenth decorative element 120) are at least generally conical in shape to allow for visual blending with the decorative element 111, as explained herein, although these decorative elements can have other shapes, including, but not limited to, generally domed, generally circular, generally semi-circular, generally triangular, generally pyramidal, generally square or rectangular, or generally parabolic, and can be symmetrical or asymmetrical, along a single plane or multiple planes. For example, the earring 100 includes the second decorative element 112 disposed on the first outer side and the third decorative element 113 disposed on the second outer side, where the decorative element 111 is disposed between the second decorative element 112 and the third decorative element 113 in the first position (e.g., closed) and the third position (e.g., closed) such that the second decorative element 112, the decorative element 111, and the third decorative element 113 collectively form a decorative pattern along the first outer side and the second outer side. Note that the decorative element 111 is at least partially pyramidal in the first position and the third position, where each of the second decorative element 112 and the third decorative element 113 is at least partially conical, which enables the decorative element 111 to visually blend with the second decorative element 112 and the third decorative element 113, as explained herein.

Although, as shown in FIG. 1-FIG. 4, the additional decorative elements (the second decorative element 112, the third decorative element 113, the fourth decorative element 114, the fifth decorative element 115, the sixth decorative element 116, the seventh decorative element 117, the eighth decorative element 118, the ninth decorative element 119, and the tenth decorative element 120) have a visually similar or identical shape to enable visual blending with the decorative element 111, in other embodiments, different decorative elements can have different shapes to visually blend with the decorative element 111, as disclosed herein. In various embodiments, the decorative elements can be at least partially or totally a gemstone, whether precious or semi-precious, whether natural or synthetic, diamond, stone, glass, metal, alloy, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones. Although the additional decorative elements in FIG. 1-FIG. 4 are shown in a single row, in other embodiments, the additional decorative elements can be in multiple rows, for example two rows, three rows, four rows five rows, six rows, or more, whether parallel or intersecting, whether as part of a single pattern or multiple patterns, or the decorative elements do not have to be aligned with each other, but can be offset in certain embodiments.

Each of the first arcuate segment 101 and the second arcuate segment 104 includes a set of prongs 121 that hold the decorative elements in place among or between which the decorative element 111 is positioned or disposed. The prongs 121 can take on any suitable configuration as long as the decorative elements remain in place via the prongs 121. For example, there may be four prongs 121 per decorative element, but this is not required and there may be less than four prongs 121 (e.g., one, two, three) or more than four prongs 121 (e.g., five, six, seven). The prongs 121 can be metal (e.g., gold, silver) or a metal alloy (e.g., steel), or can be manufactured from other materials (e.g., plastic, rubber, wood, silicon), or any combination thereof. Likewise, each of the first arcuate segment 101 and the second arcuate segment 104 can be metal (e.g., gold, silver) or a metal alloy (e.g., steel), or can be manufactured from other materials (e.g., plastic, rubber, wood, silicon), or any combination thereof. Note that the set of prongs 121 can be omitted.

As disclosed herein, although FIG. 1 shows the earring 100, this disclosure enables different types or pieces of jewelry, including, but not limited to, a bracelet, an anklet, a belt, a necklace, a ring worn on a human, mannequin, or showcase finger, thumb, or toe, or a ring worn in a human, mannequin, or showcase belly button or nose. For example, the decorative element 111 can be included in a bracelet or a ring. Although the earring 100 shown in FIG. 1 is generally circular, in other embodiments, the earring 100 or other suitable jewelry may have any shape or form factor that can adopt a generally closed configuration, including, but not limited to, oval, triangular, square, rectangular, pentagonal, hexagonal, heptagonal, octagonal, nonagonal, decagonal, polygonal, or other suitable shapes.

FIG. 1 depicts the first outer side, the first inner side 103, the first left side 124 and the first right side of the first arcuate segment 101, and the second outer side 105, the second inner side 106, the second left side 126 and the second right side of the second arcuate segment 104 as smooth, but in other embodiments, these sides can also be non-smooth (e.g., rough, textured, knurled, bumped, spiked, depressed, threaded), a combination of smooth and non-smooth, or certain sides can be smooth and other sides be non-smooth.

FIG. 1 depicts the first left side 124 and the first right side of the first arcuate segment 101, and the second left side 126 and the second right side of the second arcuate segment 104 as being straight, flat, or planar, but these sides can also be convex, concave, arced inward or outward, conical inwardly or outwardly, or can come to a point on a respective left side or a respective right side. The first arcuate segment 101 and the second arcuate segment 104 can be internally solid (e.g., a bar), but can also be hollow (e.g., a cavity or lumen) or compartmentalized (e.g., with a set of compartments).

The first arcuate segment 101 and the second arcuate segment 104 can include a metal or a metal alloy, can include other materials (e.g., plastic, rubber, wood, silicon), or any combination thereof. The first arcuate segment 101 and the second arcuate segment 104 can be rigid (e.g., unable to be manually bent), but can also be flexible (e.g., able to be manually bent), or a combination of rigid and flexible portions. The first arcuate segment 101 and the second arcuate segment 104 can each be monolithic (e.g., a single unit including a same material, additively manufactured, 3-D printed, cast, injection molded), but can also be an assembly of parts (e.g., by fastening, mating, interlocking). Each of the first arcuate segment 101 and the second arcuate segment 104 can have a cross-section that is rectangular, square, triangular, oval, circular, pentagonal, octagonal, open-shaped, closed-shaped, or any other suitable polygonal or non-polygonal shape.

The earring 100 also includes is a post or bridge 122. The post or bridge 122 can extend through a portion of an ear of a wearer after the earring 100 is opened (the first position or the third position) such that the first wall 107 and the second wall 109 are offset with each other thereby avoiding the decorative element 111 readily visually blending with the other decorative elements of the earring 100 mentioned above, inserted through the ear of the wearer while the first wall 107 and the second wall 109 are offset with each other thereby avoiding the decorative element 111 readily visually blending with the other decorative elements of the earring 100 mentioned above, and then closed (the second position and the fourth position) while the post or bridge 122 extends through the ear such that the first wall 107 and the second wall 109 are align with each other and thereby enable the decorative element 111 to readily visually blend with the other decorative elements of the earring 100 mentioned above. For example, the portion of the ear can include an earlobe (lobule), a helix, a concha, a superior concha, a crus, a superior crus, an antitragus, an antihelix, a scapha, a triangular fossa, a concha cymba, a tragus, or other suitable portions of the ear.

The post or bridge 122 can extend longitudinally from, or be connected to the first arcuate segment 101 or the second arcuate segment 104 to respectively connect, extend between, or span between the second arcuate segment 104 and the first arcuate segment 101. The post or bridge 122 can extend into the first segment 101 or the second segment 104.

Although the post or bridge 122 is shown in FIG. 1 as generally longitudinally extending as an arc that is curved along a space defined via the first inner side 103 and the second inner side 106 within the earring 100 when the earring 100 is closed (the first position or the third position), in other embodiments, the post or bridge 122 can be essentially longitudinally rectilinear over the space defined via the first inner side 103 and the second inner side 106 within the earring 100 when the earring 100 is closed (the first position or the third position), but can also be essentially non-rectilinear (e.g., U-shape, C-shape, V-shape, helical, sinusoidal, or arcuate), whether concave or convex, over the space defined via the first inner side 103 and the second inner side 106 within the earring 100 when the earring 100 is closed (the first position or the third position). The post or bridge 122 has a cross-section that is circular, but this shaping can vary (e.g., polygonal, oval, triangular, pentagonal, hexagonal, square, rectangular, symmetrical, asymmetrical, open-shape, closed-shape). The post or bridge 122 includes an outer surface that is smooth, but can be non-smooth (e.g., rough, textured, knurled, bumped, spiked, depressed, threaded). The post or bridge 122 is internally solid (e.g., a bar), but can be hollow (e.g., a cylinder) or compartmentalized (e.g., with a set of compartments). The post or bridge 122 includes a metal (e.g., gold, silver, copper) or a metal alloy (e.g., steel), but can include other materials (e.g., plastic, rubber, wood, silicon). The post or bridge 122 is rigid (e.g., unable to be manually bent), but can be flexible (e.g., able to be manually bent). The post bridge 122 is monolithic (e.g., a single unit including a same material, additively manufactured, 3-D printed, cast, injection molded), but can be an assembly of parts (e.g., by fastening, mating, interlocking).

FIG. 2A illustrates a perspective sectional view of an embodiment of an earring with a two piece decorative element in a closed position shown in FIG. 1, according to this disclosure. As shown in FIG. 2A, the earring 100 includes the first arcuate segment 101 and the second arcuate segment 104. The first arcuate segment 101 includes a first outer side, the first inner side 103, the first left side 124 and the first right side. The second arcuate segment 104 includes the second outer side 105, the second inner side, the second left side 126 and the second right side. The earring 100 includes the pivot joining the first arcuate segment 101 and the second arcuate segment 104, which collectively form a C-shape (as shown in FIGS. 1 and 2A when the earring 100 is closed).

The decorative element 111 includes the first wall 107 and the second wall 109. The first wall 107 is radially disposed on the first outer side and includes a first peak 108. The second wall 109 is radially disposed on the second outer side 105 and includes a second peak 110. The first wall 107 and the second wall 109 oppose each other when the first peak 108 and the second peak 110 are coaligned with each other in the first position or the third position (as shown in FIGS. 1 and 2A) such that the first wall 107 and the second wall 109 collectively form the decorative element 111. Also shown are the second decorative element 112, the third decorative element 113, the fourth decorative element 114, the fifth decorative element 115, the sixth decorative element 116, and the eighth decorative element 118, with additional decorative elements shown in FIG. 1. Also shown in FIG. 2A are the prongs 121 that hold these decorative elements in place, as disclosed herein.

FIG. 2B illustrates a sectional profile view of an embodiment of an earring with a two piece decorative element in a closed position shown in FIG. 1, according to this disclosure. As shown in FIG. 2B, the earring 100 includes the first arcuate segment 101 having the first outer side 102, the first inner side 103, the first left side 124, and the first right side. The second arcuate segment 104 includes the second outer side 105 and the second inner side 106, the second left side 126 and the second right side. The earring 100 includes the pivot joining the first arcuate segment 101 and the second arcuate segment 104, which collectively form a C-shape (as shown in FIGS. 1-2B when the earring 100 is closed), the first wall 107 radially disposed on the first outer side 102, where the first wall includes the first peak 108. The second wall 109 includes the second peak 110. The first wall 107 and the second wall 109 oppose each other since the first peak 108 and the second peak 100 are coaligned with each other such that the first wall 107 and the second wall 109 collectively form the decorative element 111, as shown in FIGS. 1-2A.

Figure 3A:
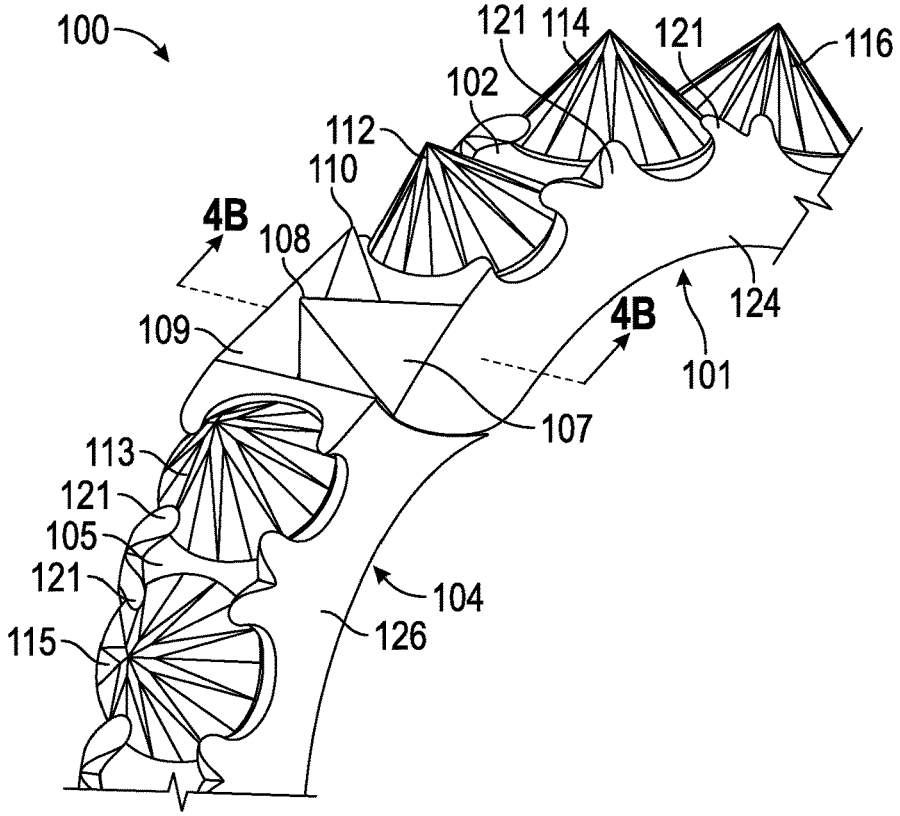
FIG. 3A is a perspective sectional view of an embodiment of an earring with a two piece decorative element in an open position according to this disclosure.
Figure 3B:
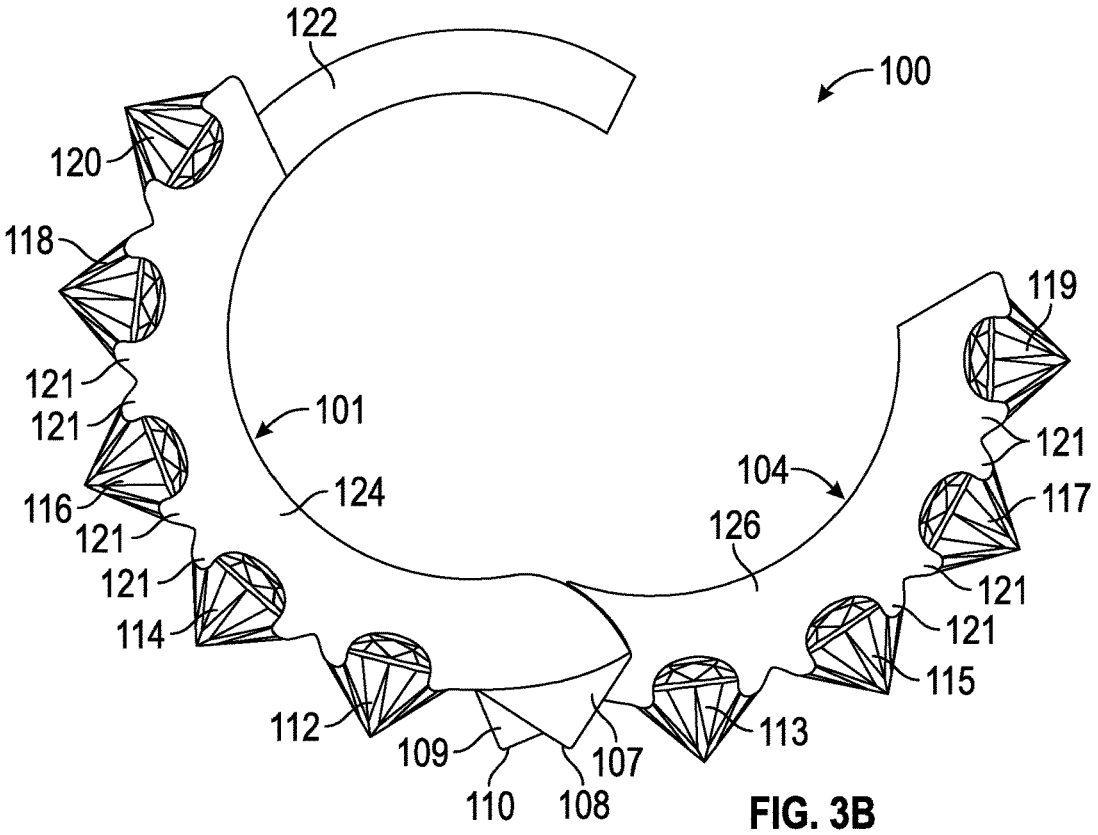
FIG. 3B is a sectional profile view of an embodiment of an earring with a two piece decorative element in an open position according to this disclosure.

FIG. 3A illustrates a perspective sectional view of an embodiment of an earring with a two piece decorative element as shown in FIG. 1 but in an open position (generally 3-shaped) along an axis 4B, according to this disclosure. As shown in FIG. 3A, the earring 100 includes the first arcuate segment 101 and the second arcuate segment 104. The first arcuate segment 101 includes the first outer side 102, the first inner side, the first left side 124 and the first right side. The second arcuate segment 104 includes the second outer side 105, the second inner side, the second left side 126, and the second right side. The earring 100 includes the pivot joining the first arcuate segment 101 and the second arcuate segment 104, which collectively form a 3-shape (as shown in FIG. 3B when the earring 100 is open). The first wall 107 is radially disposed on the first outer side 102, where the first wall 107 includes the first peak 108. The second wall 109 is radially disposed on the first outer side 105, where the second wall 109 includes the second peak 110. As shown in FIG. 3A, the first wall 107 is offset with the second wall 109 when the first peak 108 and the second peak 110 are not coaligned with each other along the axis 4B such that the first wall 107 and the second wall 109 do not collectively form the decorative element 111, as shown in FIGS. 1-2B.

FIG. 3B is a sectional profile view of an embodiment of an earring with a two piece decorative element as shown in FIG. 1 in an open position (3-shaped) according to this disclosure. As shown in FIG. 3B, the earring 100 includes the first arcuate segment 101 and the second arcuate segment 104. The first arcuate segment 101 includes the first outer side 102, the first inner side 103, the first left side 124, and the first right side. The second arcuate segment 104 includes the second outer side 105, the second inner side 106, the second left side 126, and the second right side.

The earring 100 includes the pivot joining the first arcuate segment 101 and the second arcuate segment 104 such that the first arcuate segment 104 is configured to move (e.g., rotate) about the pivot relative to the second arcuate segment 104 between the first position (e.g., open) and the second position (e.g., closed) or the second arcuate segment 104 is configured to move (e.g., rotate) about the pivot relative to the first arcuate segment 101 between the third position (e.g., open) and the fourth position (e.g., closed).

The first arcuate segment 101 and the second arcuate segment 104 collectively form a C-shape in the first position and the third position (as shown in FIGS. 1-2A when the earring 100 is closed). The first arcuate segment 101 and the second arcuate segment 104 collectively form a 3-shape in the second position and the fourth position (as shown in FIGS. 3A-3B when the earring 100 is open).

The first wall 107 includes the first peak 108 and is radially disposed on the first outer side 102 such that the pivot extends between the first inner side 103 and the first wall 107. The second wall 109 includes the second peak 110 and is radially disposed on the second outer side 105 such that the pivot extends between the second inner side 106 and the second wall 109. The first wall 107 and the second wall 109 oppose each other when the first peak 108 and the second peak 110 are coaligned with each other in the first position and the third position (as shown in FIGS. 1-2A) such that the first wall 107 and the second wall 109 collectively form the decorative element 111, as disclosed herein. The first wall 107 is offset with the second wall 109 when the first peak 108 and the second peak 110 are not coaligned with each other in the second position and the fourth position (as shown in FIGS. 3A-3B) such that the first wall 107 and the second wall 109 do not collectively form the decorative element 111, as disclosed herein. In various embodiments, the 3-shape collectively formed by the first arcuate segment 101 and the second arcuate segment 104 can be symmetrical or asymmetrical, depending on where the pivot is positioned in the earring 100.

Figure 4A:
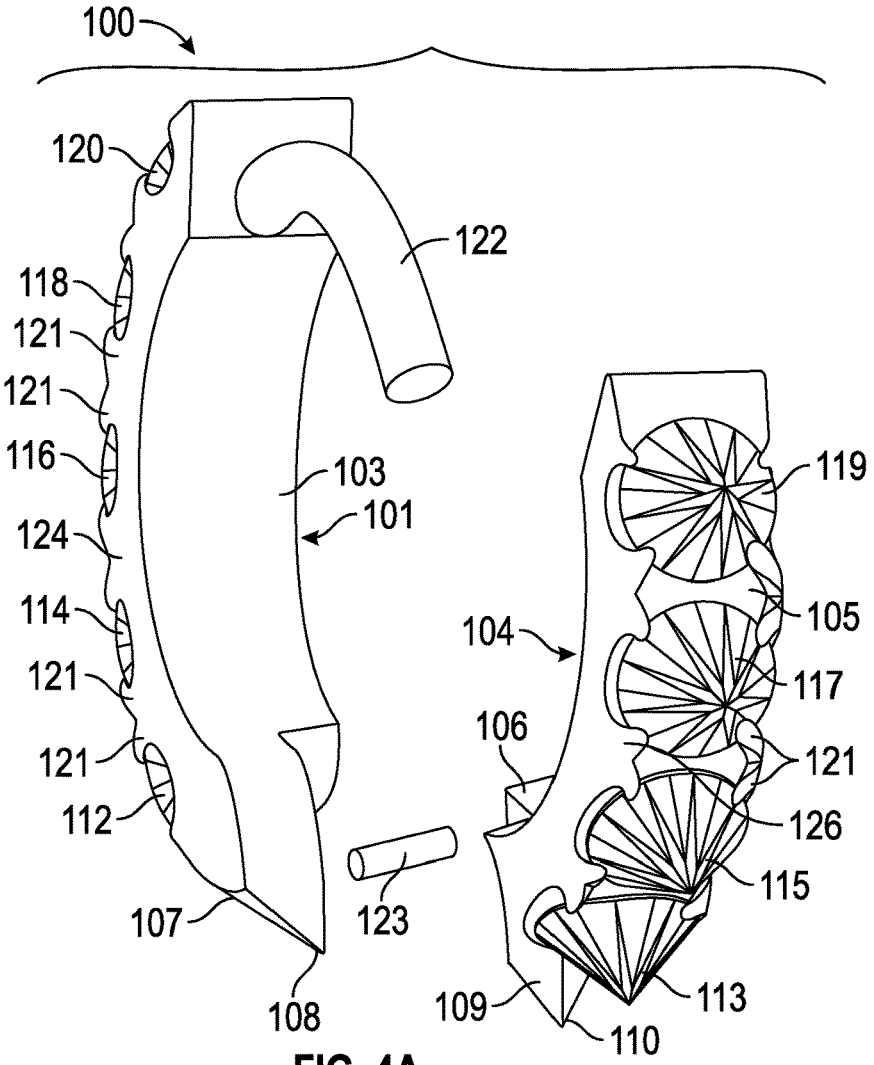
FIG. 4A is an exploded perspective view of an embodiment of an earring with a two piece decorative element according to this disclosure.

FIG. 4A illustrates an exploded perspective view of an embodiment of an earring with a two piece decorative element as shown in FIG. 1 according to this disclosure. As shown in FIG. 4A, the earring 100 includes the first arcuate segment 101 and the second arcuate segment 104 and the pivot, where the pivot is embodied as a pin 123 joining the first arcuate segment 101 and the second arcuate segment 104 such that the first arcuate segment 104 is configured to move (e.g., rotate) about the pin 123 relative to the second arcuate segment 104 between the first position (e.g., closed) and the second position (e.g., open) or the second arcuate segment 104 is configured to move (e.g., rotate) about the pin 123 relative to the first arcuate segment 101 between the third position (e.g., closed) and the fourth position (e.g., open). The pin 123 can enable free movement or elastic movement (e.g., a spring) between the first position and the second position or the third position and the fourth position. For example, the second segment 104 can monolithically include the pin 123 onto which the first segment 101 mates and about which the first segment 101 pivots (e.g., rotates).

The pin 123 has a cross-section that is circular, but this shaping can vary (e.g., polygonal, oval, triangular, pentagonal, hexagonal, square, rectangular, symmetrical, asymmetrical, open-shape, closed-shape) as long as the first arcuate segment 101 can move (e.g., rotate) about the pin 123 relative to the second arcuate segment 104 between the first position (e.g., open) and the second position (e.g., closed) or the second arcuate segment 104 can move (e.g., rotate) about the pin 123 relative to the first arcuate segment 101 between the third position (e.g., open) and the fourth position (e.g., closed).

The pin 123 includes an outer surface that is smooth, but can be non-smooth (e.g., rough, textured, knurled, bumped, spiked, depressed, threaded) as long as the first arcuate segment 101 can move (e.g., rotate) about the pin 123 relative to the second arcuate segment 104 between the first position (e.g., open) and the second position (e.g., closed) or the second arcuate segment 104 can move (e.g., rotate) about the pin 123 relative to the first arcuate segment 101 between the third position (e.g., open) and the fourth position (e.g., closed). The pin 123 is internally solid (e.g., a bar), but can be hollow (e.g., a cylinder) or compartmentalized (e.g., with a set of compartments). The pin 123 includes a metal (e.g., gold, silver) or a metal alloy (e.g., steel), but can include other materials (e.g., plastic, rubber, wood, silicon). The pin 123 is rigid (e.g., unable to be manually bent), but can be flexible (e.g., able to be manually bent). The pin 123 is monolithic (e.g., a single unit including a same material, additively manufactured, 3-D printed, cast, injection molded), but can be an assembly of parts (e.g., by fastening, mating, interlocking). The pin 123 can be monolithic or assembled with the first arcuate segment 101 or the second arcuate segment 104. The pin 123 can extend into the first arcuate segment 101 or the second arcuate segment 104. The pin 123 is rectilinear, but can be arcuate, sinusoidal, or other suitable shapes.

Figure 4B:
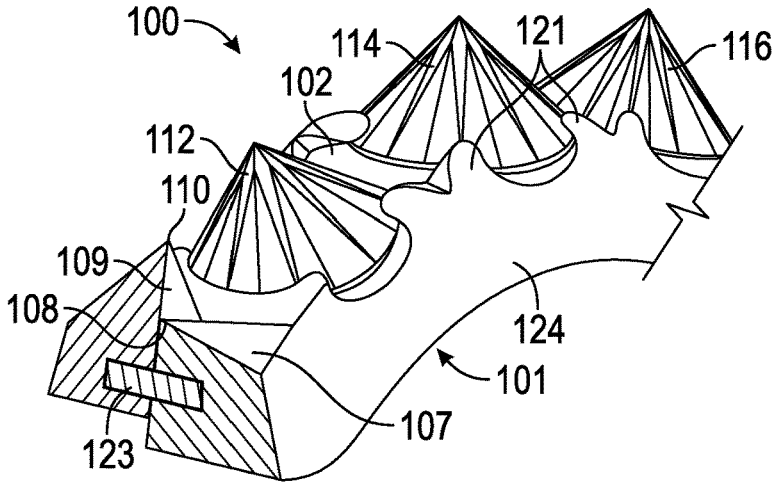
FIG. 4B is a perspective cross-sectional view of an embodiment of an earring with a two piece decorative element in the open position according to this disclosure.

FIG. 4B is a perspective cross-sectional view of an embodiment of an earring with a two piece decorative element as shown in FIG. 1 in an open position (3-shaped) according to this disclosure. As shown in FIG. 4B, the pin 123 joins the first arcuate segment 101 and the second arcuate segment 104 such that the first arcuate segment 104 is configured to move (e.g., rotate) about the pin 123 relative to the second arcuate segment 104 between the first position (e.g., closed) and the second position (e.g., open) or the second arcuate segment 104 is configured to move (e.g., rotate) about the pin 123 relative to the first arcuate segment 101 between the third position (e.g., closed) and the fourth position (e.g., open). The pin 123 extends (e.g., spans) between the first arcuate segment 101 and the second arcuate segment 104. Note that the pin 123 can enable free movement (e.g., no or minimum resistance) or elastic movement (e.g., a spring) between the first position and the second position or the third position and the fourth position.

The first arcuate segment 101 and the second arcuate segment 104 collectively form a C-shape in the first position and the third position (as shown in FIGS. 1-2B when the earring 100 is closed). For example, the earring 100 can be O-shaped or D-shaped where the first arcuate segment 101 and the second arcuate segment 104 collectively form the C-shape therein. The first arcuate segment 101 and the second arcuate segment 104 collectively form a 3-shape in the second position and the fourth position (as shown in FIGS. 3*b* and 4B when the earring 100 is open). For example, the earring 100 can be O-shaped or D-shaped where the first arcuate segment 101 and the second arcuate segment 104 collectively form the C-shape therein. The first wall 107 includes the first peak 108 and is radially disposed on the first outer side 102 such that the pin 123 extends between the first inner side 103 and the first wall 107. The second wall 109 includes the second peak 110 and is radially disposed on the second outer side 105 such that the pin 123 extends between the second inner side 106 and the second wall 109.

Figure 5:
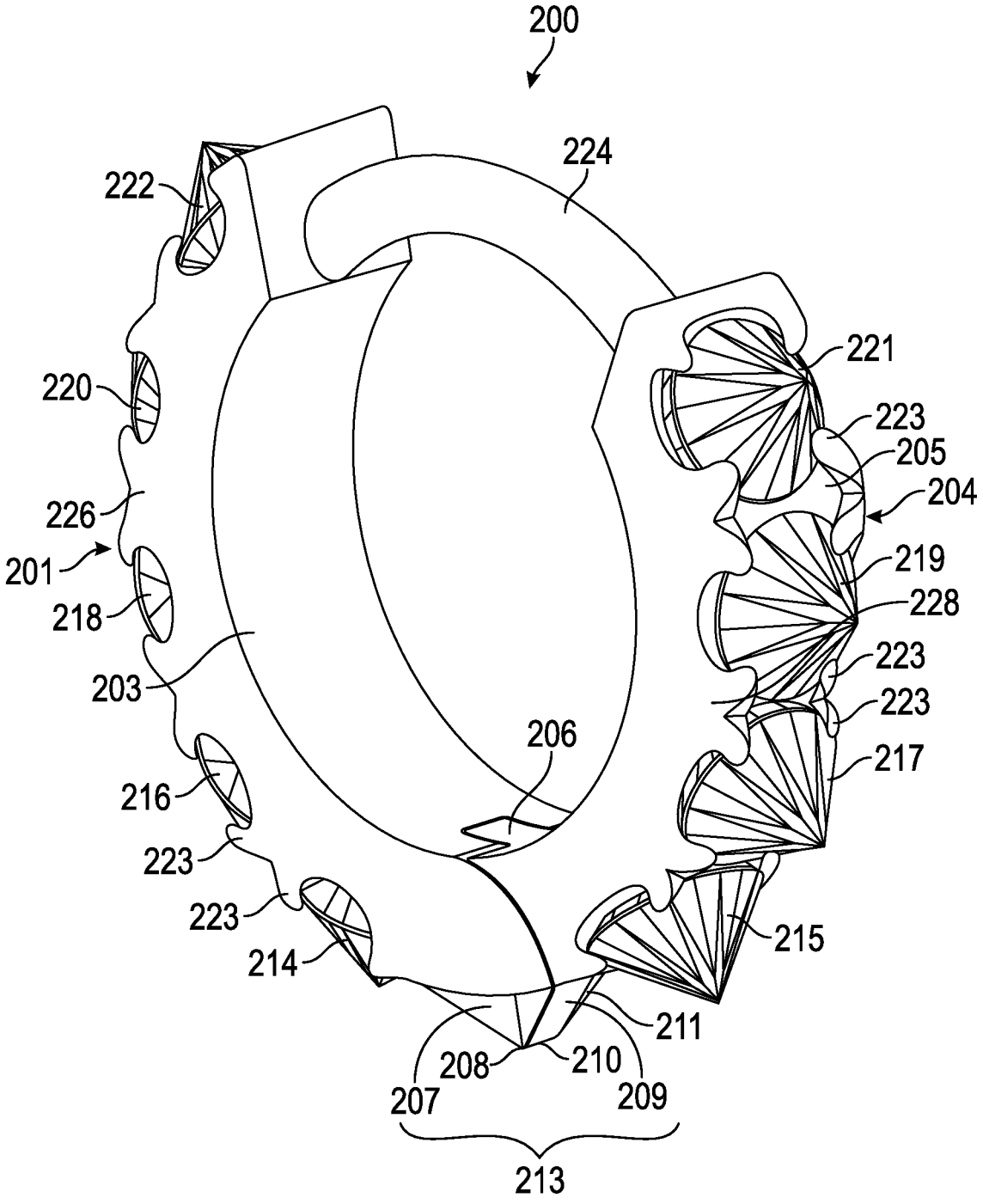
FIG. 5 is a perspective view of an embodiment of an earring with a three piece decorative element in a closed position according to this disclosure.

FIG. 5 is a perspective view of an embodiment of an earring with a three piece decorative element in a closed position according to this disclosure. As shown in FIG. 5, an earring 200 is similar to the earring 100 and includes a first arcuate segment 201 and a second arcuate segment 204. The first arcuate segment 201 can be structurally or functionally similar to the first arcuate segment 101. The second arcuate segment 204 can be structurally or functionally similar to the second arcuate segment 104.

As similarly explained above, the first arcuate segment 201 includes a first outer side, a first inner side 203, a first left side 226, and a first right side. The second arcuate segment 204 includes a second outer side 205, a second inner side 206, a second left side 228, and a second right side. The first left side 226 and the first right side extends from the first outer side or the first inner side 203, or the second left side 228 and second right side extends from the second outer side 205 or the second inner side 206. For example, the first left side 226 and the first right side span between the first outer side and the first inner side 203, or the second left side 228 and the second right side span between the second outer side 205 and the second inner side 206.

Figure 7A:
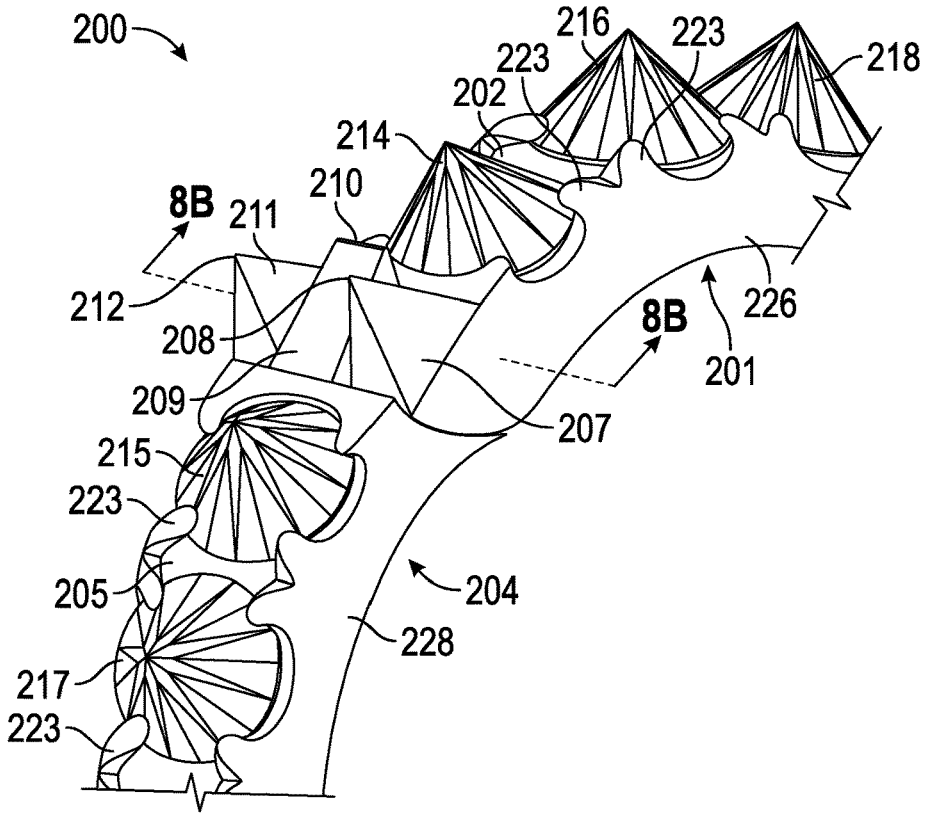
FIG. 7A is a perspective sectional view of an embodiment of an earring with a three piece decorative element in an open position according to this disclosure.
Figure 7B:
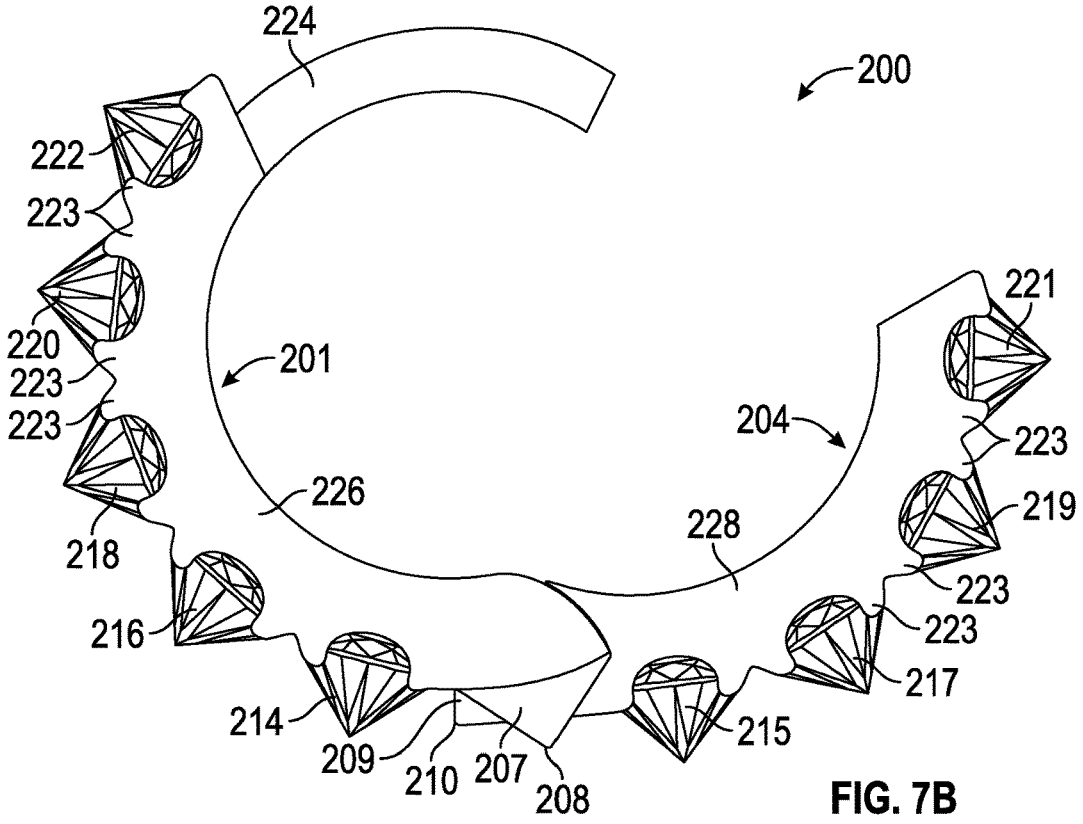
FIG. 7B is a sectional profile view of an embodiment of an earring with a three piece decorative element in an open position according to this disclosure.

As similarly explained above, the earring 200 includes a pivot joining the first arcuate segment 201 and the second arcuate segment 204 such that the first arcuate segment 201 is configured to move (e.g., rotate) about the pivot relative to the second arcuate segment 204 between a first position (e.g., closed) and a second position (e.g., open) or the second arcuate segment 204 is configured to move about the pivot relative to the first arcuate segment 201 between a third position (e.g., open) and a fourth position (e.g., closed). The first arcuate segment 201 and the second arcuate segment 204 collectively form a C-shape in the first position (e.g., open) and the third position (e.g., open), as shown in FIG. 5 when the earring 200 is closed. The first arcuate segment 201 and the second arcuate segment 204 collectively form a 3-shape in the second position (e.g., closed) and the fourth position (e.g., closed), as shown in FIG. 7B when the earring 200 is open.

As similarly explained above, the earring 200 includes a first wall 207, a second wall 209, and a third wall 211. The first wall 208 includes a first peak 208 and is radially disposed on the first outer side such that the pivot extends between the first inner side 203 and the first wall 207. The second wall 209 includes a second peak 210 and is radially disposed on the second outer side 205 such that the pivot extends between the second inner side 206 and the second wall 209. The third wall 211 includes a third peak and is radially disposed on the first outer side such that the pivot extends between the first inner side 203 and the third wall 211. The second wall 209 is interposed or extends between the first wall 207 and the third wall 211 when the first peak 208, the second peak 210, and the third peak are coaligned with each other in the first position (e.g., open) and the third position (e.g., open) such that the first wall 207, the second wall 209, and the third wall further collectively form a decorative element 213 in the first position (e.g., open) and the third position (e.g., open). The decorative element 213 may be functionally or structurally similar to the decorative element 111. The third wall is offset with the second wall 209 when the third peak and the second peak 210 are not coaligned with each other in the second position (e.g., open) and the fourth position (e.g., open) such that the third wall or the first wall 207 and the second wall 209 do not further collectively form the decorative element 219, as shown in FIG. 7A. Each of the first wall 207, the second wall 209, or the third wall 211 can be at least partially or totally a gemstone, whether precious or semi-precious, whether natural or synthetic, diamond, stone, glass, metal, alloy, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones.

The first wall 207 can have a first optical property (e.g., color, reflectivity, luster), the second wall 209 can have a second optical property (e.g., color, reflectivity, luster), and the third wall 211 can have a third optical property (e.g., color, reflectivity, luster). The first optical property can be identical to the second optical property or the third optical property. For example, at least two of the first wall 207, the second wall 209, or the third wall 211 can collectively present a single optical appearance. The first optical property can be different from the second optical property or the third optical property. For example, at least two of the first wall 207, the second wall 209, or the third wall 211 can avoid collectively presenting a single optical appearance.

Figure 6A:
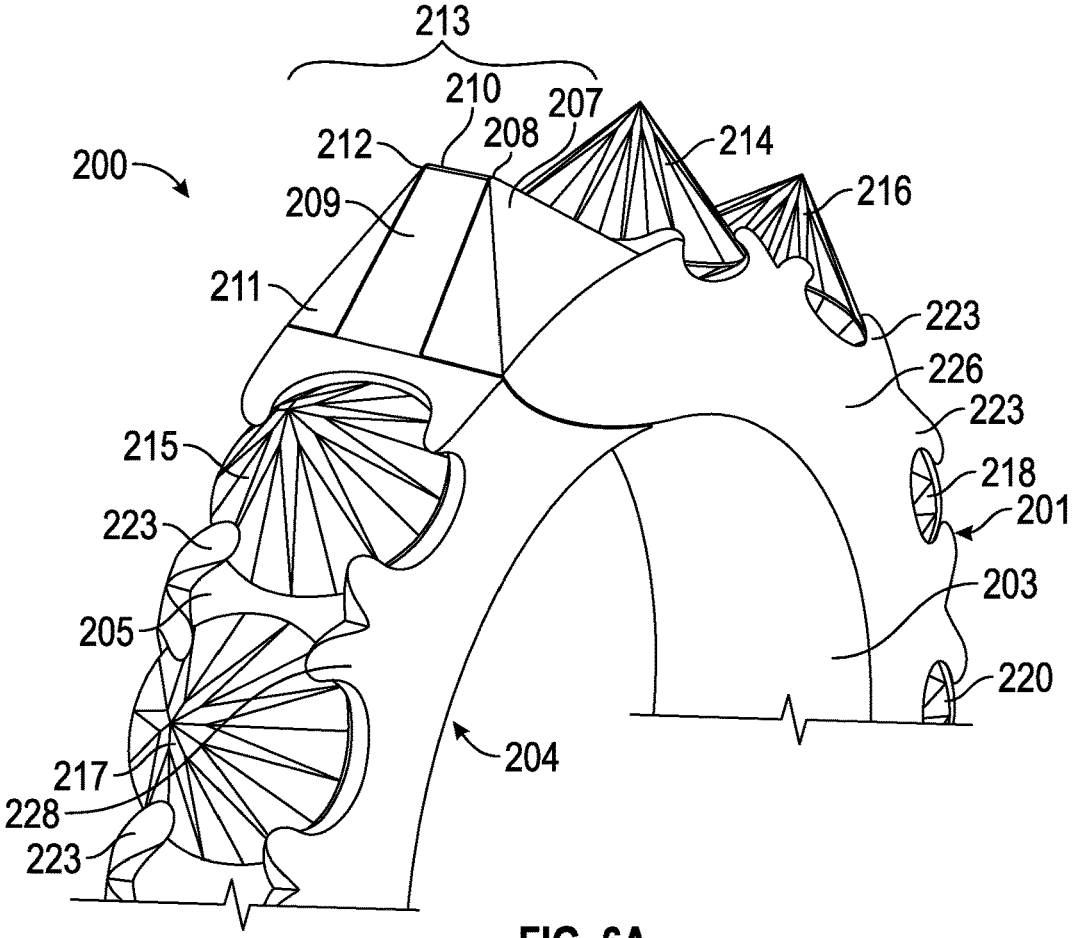
FIG. 6A is a perspective sectional view of an embodiment of an earring with a three piece decorative element in a closed position according to this disclosure.
Figure 6B:
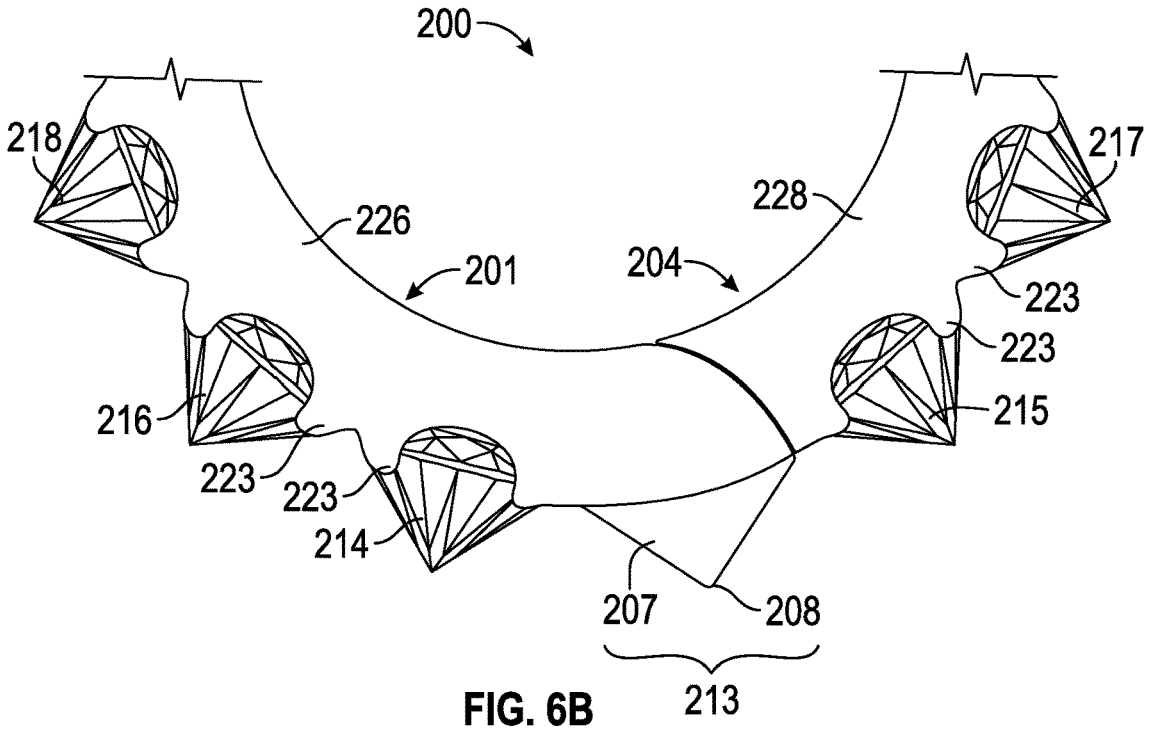
FIG. 6B is a sectional profile view of an embodiment of an earring with a three piece decorative element in a closed position according to this disclosure.

In the earring 200 depicted in FIG. 5, FIG. 6A and FIG. 6B, the decorative element 213 can be a first decorative element, and also shown are a second decorative element 214, a third decorative element 215, a fourth decorative element 216, a fifth decorative element 217, a sixth decorative element 218, a seventh decorative element 219, an eighth decorative element 220, a ninth decorative element 221, and a tenth decorative element 222. However in other embodiments, the earring 200 (or other piece of jewelry) can have more of such decorative elements or less of such decorative elements, and resultantly can have any suitable number of decorative elements. These decorative elements can collectively form a sequential decorative pattern (e.g., arcuately disposed), as shown in FIG. 5 and explained above, to visually blend with the decorative element 213 such that the decorative element 213 is not readily visually distinguishable from other decorative elements forming the sequential decorative pattern when the decorative element 213 is included in the sequential decorative pattern among other decorative elements in the sequential decorative pattern, whether being interposed between two decorative elements or being an ending decorative element in the sequential decorative pattern. Note that other decorative patterns may be formed (e.g., a geometrical pattern, a linear pattern, a rectilinear pattern, a sinusoidal pattern, a zigzag pattern, a polygonal pattern, an oval pattern, a circular pattern, a closed-shape pattern, an open-shape pattern, a character pattern, a star pattern, an animal pattern, a natural phenomenon pattern, a planetary pattern), whether additionally or alternatively, whether alone, integrated with, parallel, or intersecting with other decorative patterns.

As shown in FIG. 5, the decorative element 213 is at least generally pyramidal in shape. Although depicted as a four-sided pyramid, other configurations are possible, such as a three-sided pyramid. Additionally, the decorative element 213 can have other shapes, including, but not limited to, generally domed, generally semi-circular, generally square or rectangular, or generally parabolic, and can be symmetrical or asymmetrical, along a single plane or multiple planes. As shown in FIG. 5 the additional decorative elements (the second decorative element 214, the third decorative element 215, the fourth decorative element 216, the fifth decorative element 217, the sixth decorative element 218, the seventh decorative element 219, the eighth decorative element 220, the ninth decorative element 221, and the tenth decorative element 222) are at least generally conical in shape, although again these decorative elements can have other shapes, including, but not limited to, generally domed, generally circular, generally semi-circular, generally triangular, generally pyramidal, generally square or rectangular, or generally parabolic, or others as explained above to have a visually similar or identical shape to enable visual blending with the decorative element 213, as disclosed herein. Although, as shown in FIG. 5, the additional decorative elements (the second decorative element 214, the third decorative element 215, the fourth decorative element 216, the fifth decorative element 217, the sixth decorative element 218, the seventh decorative element 219, the eighth decorative element 220, the ninth decorative element 221, and the tenth decorative element 222) have a similar or identical shape, in other embodiments, these decorative elements can have different shapes yet have a visually similar or identical shape to enable visual blending with the decorative element 213, as disclosed herein. As explained above, in various embodiments, these decorative elements can be at least partially or totally a gemstone, either precious or semi-precious, stone, glass, metal, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones. Although the additional decorative elements in FIG. 5 are shown disposed in a single row, in other embodiments, the additional decorative elements can be disposed in multiple rows, for example two rows, three rows, four rows five rows, six rows, or more. Additionally, the additional decorative elements do not have to be aligned with each other, but can be offset with each other. As similarly explained above, FIG. 5 also illustrates the earring 200 including prongs 223 that hold the additional decorative elements in place. The prongs 223 can take on any configuration as long as the additional decorative elements remain in place. The prongs 223 can be metal or a metal alloy, or can be manufactured from other materials (e.g., plastic, rubber, wood, silicon), or any combination thereof. Note that the prongs 223 can be omitted. Although FIG. 5 shows the earring 200, in other embodiments, any number of different types or pieces of jewelry, including, but not limited to, a bracelet, an anklet, a belt, a necklace, a ring worn on a finger, thumb, or toe, a ring worn in the belly button or nose, or other suitable pieces of jewelry or devices are possible. Although the earring 200 shown in FIG. 5 is generally circular, in other embodiments, this disclosure enables jewelry having any shape that can adopt a generally closed configuration, including, but not limited to, oval, triangular, square, rectangular, pentagonal, hexagonal, heptagonal, octagonal, nonagonal, decagonal, polygonal, or other suitable shapes, whether closed-shaped or open-shaped.

FIG. 5 depicts the first inner side 203, the first outer side, the first left side 226 and the first right side of the first arcuate segment 201, and the second outer side 205, the second inner side 206, the second left side 228 and the second right side of the second arcuate segment as smooth, but in other embodiments, these sides can also be non-smooth (e.g., rough, textured, knurled, bumped, spiked, depressed, threaded), a combination of smooth and non-smooth, or certain sides can be smooth and other sides be non-smooth. The first arcuate segment 201 and second arcuate segment 204 can be internally solid (e.g., a bar), but can also be hollow (e.g., a cylinder) or compartmentalized (e.g., with a set of compartments). The first arcuate segment 201 and the second arcuate segment 204 can each include a metal (e.g., gold, silver) or a metal alloy (e.g., steel), can include other materials (e.g., plastic, rubber, wood, silicon), or any combination thereof. The first arcuate segment 201 and the second arcuate segment 204 can be rigid (e.g., unable to be manually bent), but can also be flexible (e.g., able to be manually bent), or a combination of rigid and flexible portions. The first arcuate segment 201 and the second arcuate segment 204 can each be monolithic (e.g., a single unit including a same material, additively manufactured, subtractively manufactured, 3-D printed, cast, injection molded, made via CNC machine, lathe, carving, chiseling), but can also be an assembly of parts (e.g., by fastening, mating, interlocking).

As similarly explained above, also shown in FIG. 5 is the earring 200 including a post or bridge 224. Note that the post or bridge 224 can extend through a portion of the ear of the wearer. For example, the portion of the ear can include an earlobe (lobule), a helix, a concha, a superior concha, a crus, a superior crus, an antitragus, an antihelix, a scapha, a triangular fossa, a concha cymba, a tragus, or other suitable portions of the ear. The post or bridge 224 can extend longitudinally from, or be connected to or extend into the first arcuate segment 201 or the second arcuate segment 204. Although the post or bridge 224 is shown in FIG. 5 as generally longitudinally extending as an arc that is curved along a space defined via the first inner side 203 and the second inner side 206 within the earring 200 when the earring 200 is closed (the first position or the third position), in other embodiments, the post or bridge 224 can be essentially longitudinally rectilinear over the space defined via the first inner side 203 and the second inner side 206 within the earring 200 when the earring 200 is closed (the first position or the third position), but can also be essentially non-rectilinear (e.g., U-shape, C-shape, V-shape, helical, sinusoidal, or arcuate), whether concave or convex, over the space created within the closed earring. The post or bridge 224 has a cross-section that is circular, but this shaping can vary (e.g., polygonal, oval, triangular, pentagonal, hexagonal, square, rectangular, symmetrical, asymmetrical, open-shape, closed-shape). The post or bridge 224 includes an outer surface that is smooth, but can be non-smooth (e.g., rough, textured, knurled, bumped, spiked, depressed, threaded). The post or bridge 224 is internally solid (e.g., a bar), but can be hollow (e.g., a cylinder) or compartmentalized (e.g., with a set of compartments). The post or bridge 224 includes a metal or a metal alloy, but can include other materials (e.g., plastic, rubber, wood, silicon). The post or bridge 224 is rigid (e.g., unable to be manually bent), but can be flexible (e.g., able to be manually bent). The post bridge 224 is monolithic (e.g., a single unit including a same material, additively manufactured, 3-D printed, cast, injection molded), but can be an assembly of parts (e.g., by fastening, mating, interlocking).

FIG. 6A is a perspective sectional view of an embodiment of an earring with a three piece decorative element as shown in FIG. 5 in a closed position according to this disclosure. As shown in FIG. 6A and similarly explained above, the earring 200 includes the first arcuate segment 201 having the first outer side, the first inner side 203, the first left side 226 and the first right side. Likewise, the earring 200 includes the second arcuate segment 204 having the second outer side 205, the second inner side, the second left side 228 and the second right side. Further, the earring 200 includes the pivot joining the first arcuate segment 201 and the second arcuate segment 204, which collectively form the C-shape (as shown in FIG. 6A when the earring 200 is closed).

The earring 200 includes the first wall 207, the second wall 209, and the third wall 211. The first wall 207 includes the first peak 208 and is radially disposed on the first outer side. The second wall 209 includes the second peak 210 and is radially disposed on the second outer side 205. The third wall 211 includes a third peak 212 and is radially disposed on the first outer side such that the pivot extends between the first inner side 203 and the third wall 211. The second wall 209 is interposed or extends between the first wall 207 and the third wall 211 when the first peak 208, the second peak 210, and the third peak 212 are coaligned with each other in the first position (e.g., closed) and the third position (e.g., closed) such that the first wall 207, the second wall 209, and the third wall 211 further collectively form the decorative element 213, in this example a first decorative element. Also shown are the second decorative element 214, the third decorative element 215, the fourth decorative element 216, the fifth decorative element 217, the sixth decorative element 218, and the eighth decorative element 219, with the additional decorative elements shown in FIG. 5. Also shown in FIG. 6A is the earring having the prongs 223 that hold the additional decorative elements in place.

FIG. 6B is a sectional profile view of an embodiment of an earring with a three piece decorative element as shown in FIG. 5 in a closed position according to this disclosure. As shown in FIG. 6B and similarly explained above, the earring 200 includes the first arcuate segment 201 having the first outer side and first inner side, the first left side 226, and the first right side. Likewise, the earring 200 includes the second arcuate segment 204 having the second outer side and the second inner side, the second left side 228, and the second right side. Further, the earring 200 includes the pivot joining the first arcuate segment 201 and the second arcuate segment 204, which collectively form the C-shape (as shown in FIG. 6B when the 200 earring is closed). The first wall 207, the second wall 209, and the third wall 211 oppose each other since the first peak 208, the second peak 210, and the third peak 212 are coaligned with each other such that the first wall 207, the second wall 209, and the third wall 211 collectively form the decorative element 213.

FIG. 7A is a perspective sectional view of an embodiment of an earring with a three piece decorative element as shown in FIG. 5 in an open position along an axis 8B according to this disclosure. FIG. 7B is a sectional profile view of an embodiment of an earring with a three piece decorative element as shown in FIG. 5 in an open position according to this disclosure. In particular, as similarly explained above, the earring 200 includes the first arcuate segment 201, the second arcuate segment 204, and the pivot joining the first arcuate segment 201 and the second arcuate segment 204 such that the first arcuate segment 201 and the second arcuate segment 204 collectively form a 3-shape shown in FIG. 7B the earring 200 is open. The first wall 207 and the third wall 211 are offset with the second wall 209 when the first peak 208 and the second peak 210 are not coaligned with each other and the second peak 210 and the third peak 212 are not coaligned with each other such that the first wall 207, the second wall 209 and the third wall 211 do not collectively form the decorative element 213. The pivot joins the first arcuate segment 201 and the second arcuate segment 204 such that the first arcuate segment 201 is configured to move (e.g., rotate) about the pivot relative to the second arcuate segment 204 between the first position (e.g., closed) and the second position (e.g., closed) or the second arcuate segment 204 is configured to move about the pivot relative to the first arcuate segment 201 between the third position (e.g., closed) and the fourth position (e.g., closed). The first arcuate segment 201 and the second arcuate segment 204 collectively form the C-shape in the first position (e.g., closed) and the third position (e.g., closed) as shown in FIG. 5 when the earring 200 is closed. The first arcuate segment 201 and the second arcuate segment 204 collectively form the 3-shape in the second position (e.g., open) and the fourth position (e.g., open) as shown in FIG. 7B when the earring 200 is open. The 3-shape collectively formed by the first arcuate segment 201 and the second arcuate segment 204 can be symmetrical or asymmetrical.

Figure 8A:
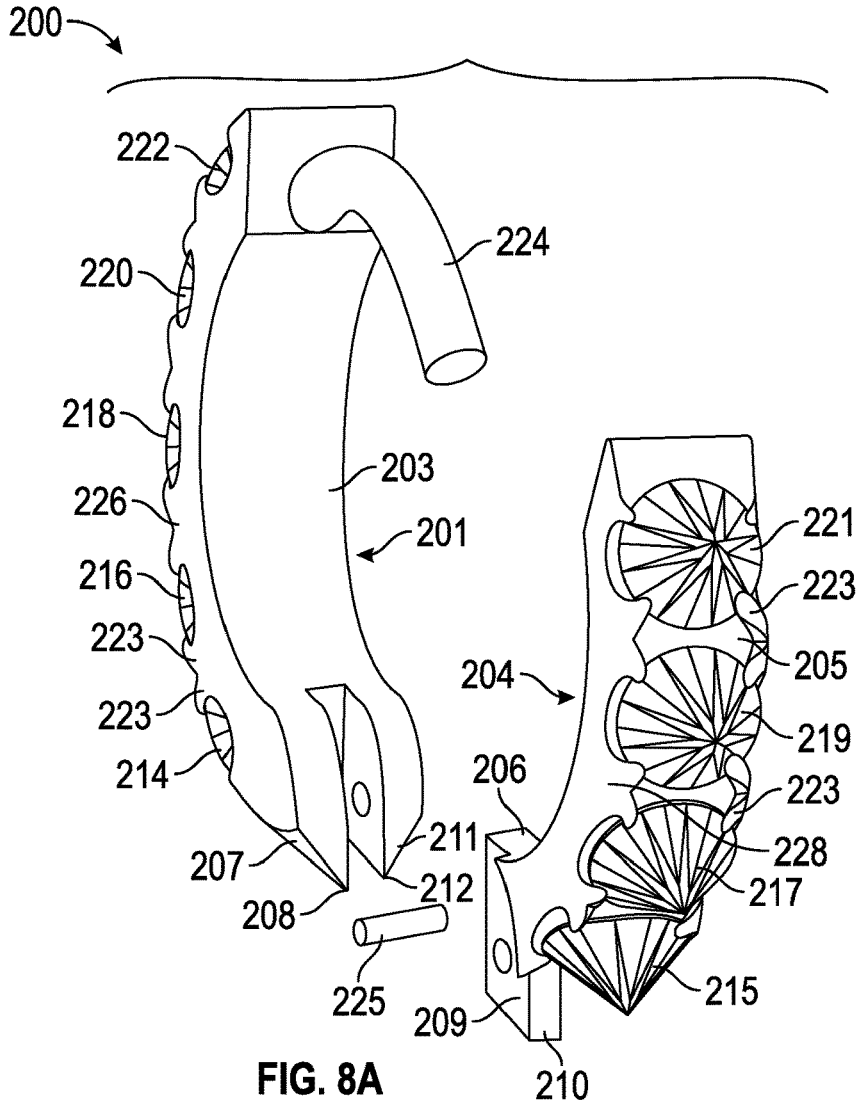
FIG. 8A is an exploded perspective view of an embodiment of an earring with a three piece decorative element according to this disclosure.
Figure 8B:
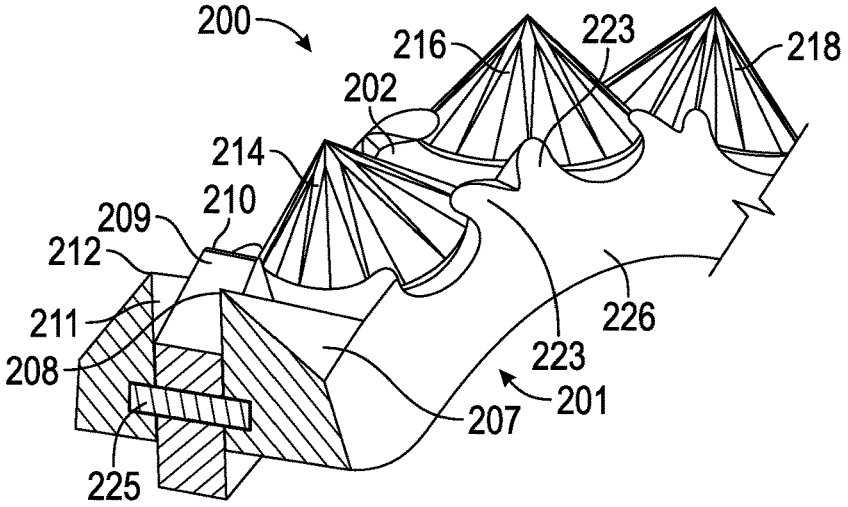
FIG. 8B is a perspective cross-sectional view of an embodiment of an earring with a three piece decorative element in an open position according to this disclosure.

FIG. 8A is an exploded perspective view of an embodiment of an earring with a three piece decorative element as shown in FIG. 5 according to this disclosure. FIG. 8B is a perspective cross-sectional view of an embodiment of an earring with a three piece decorative element as shown in FIG. 5 in the open position (3-shape) according to this disclosure. As shown in FIGS. 8A, 8B and similarly explained above, the earring 200 includes the first arcuate segment 201, the second arcuate segment 204, and the pivot joining the first arcuate segment 201 and the second arcuate segment 204.

The pivot is embodied as a pin 225 such that the first arcuate segment 201 is configured to move about the pin 225 relative to the second arcuate segment 204 between the first position (e.g., closed) and the second position (e.g., closed) or the second arcuate segment 204 is configured to move about the pin 225 relative to the first arcuate segment 201 between the third position (e.g., open) and the fourth position (e.g., open). The pin 225 extends (e.g., spans) between the first arcuate segment 201 and the second arcuate segment 204. For example, the second segment 204 can monolithically include the pin 225 onto which the first segment 201 mates and about which the first segment 201 pivots (e.g., rotates). The first arcuate segment 201 and the second arcuate segment 204 collectively form a 3-shape shown in FIG. 7B the earring 200 is open. The first wall 207 and the third wall 211 are offset with the second wall 209 when the first peak 208 and the second peak 210 are not coaligned with each other and the second peak 210 and the third peak 212 are not coaligned with each other such that the first wall 207, the second wall 209 and the third wall 211 do not collectively form the decorative element 213.

The pin 225 has a cross-section that is circular, but this shaping can vary (e.g., polygonal, oval, triangular, pentagonal, hexagonal, square, rectangular, symmetrical, asymmetrical, open-shape, closed-shape) as long as the first arcuate segment 201 can move (e.g., rotate) about the pin 225 relative to the second arcuate segment 204 between the first position (e.g., closed) and the second position (e.g., open) or the second arcuate segment 204 can move (e.g., rotate) about the pin 225 relative to the first arcuate segment 201 between the third position (e.g., closed) and the fourth position (e.g., open). The pin 225 includes an outer surface that is smooth, but can be non-smooth (e.g., rough, textured, knurled, bumped, spiked, depressed, threaded) as long as the first arcuate segment 201 can move (e.g., rotate) about the pin 225 relative to the second arcuate segment 204 between the first position (e.g., closed) and the second position (e.g., open) or the second arcuate segment 204 can move (e.g., rotate) about the pin 225 relative to the first arcuate segment 201 between the third position (e.g., closed) and the fourth position (e.g., open). The pin 225 is internally solid (e.g., a bar), but can be hollow (e.g., a cylinder) or compartmentalized (e.g., with a set of compartments). The pin 225 includes a metal (e.g., gold, silver) or a metal alloy (e.g., steel), but can include other materials (e.g., plastic, rubber, wood, silicon). The pin 225 is rigid (e.g., unable to be manually bent), but can be flexible (e.g., able to be manually bent). The pin 225 is monolithic (e.g., a single unit including a same material, additively manufactured, 3-D printed, cast, injection molded), but can be an assembly of parts (e.g., by fastening, mating, interlocking).

Figure 9A:
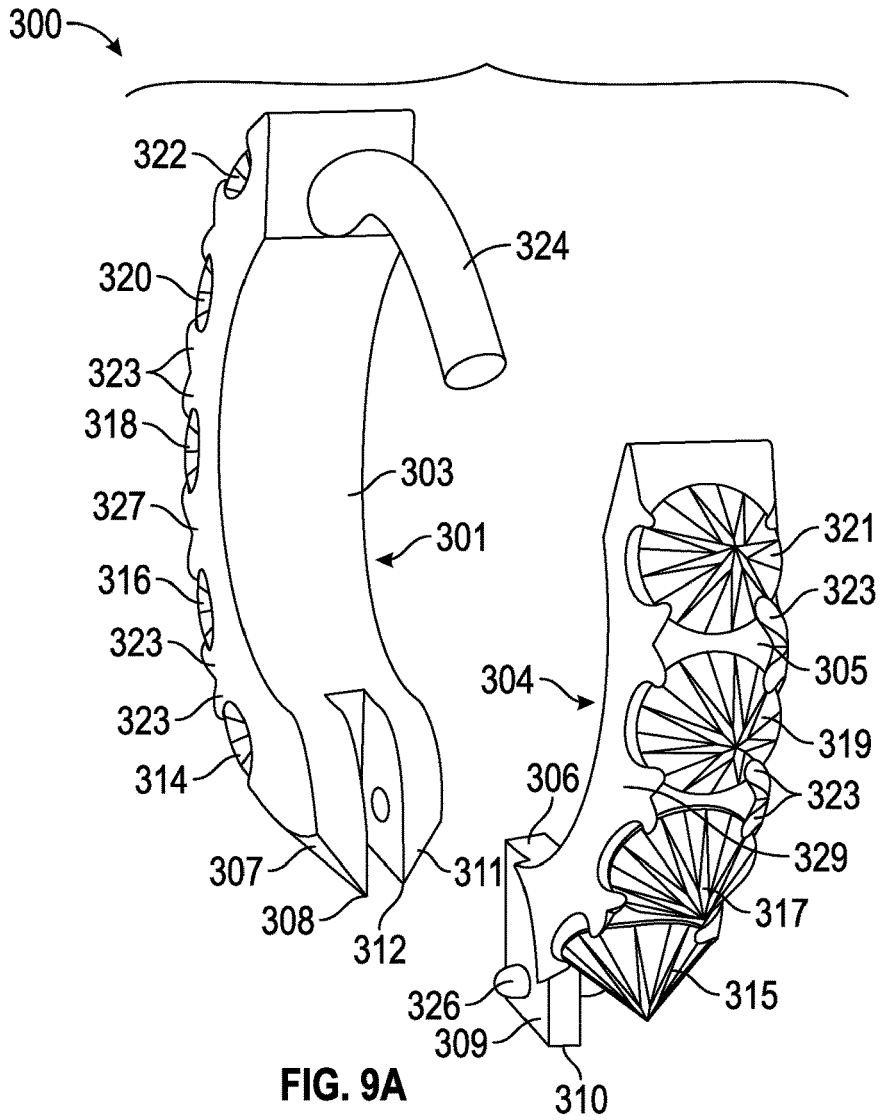
FIG. 9A is an exploded perspective view of an embodiment of an earring with a three piece decorative element according to this disclosure.
Figure 9B:
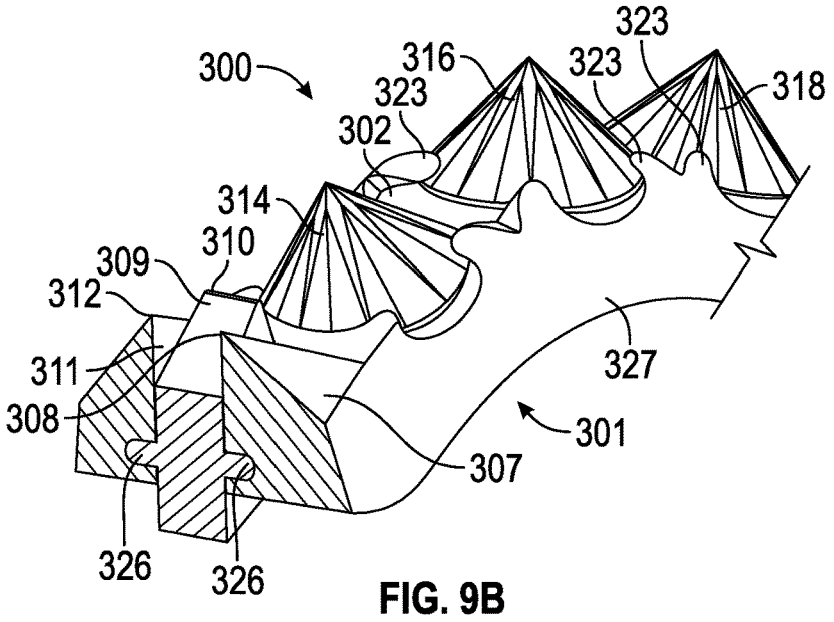
FIG. 9B is a perspective cross-sectional view of an embodiment of an earring with a three piece decorative element in an open position according to this disclosure.

FIG. 9A is an exploded perspective view of an embodiment of an earring with a three piece decorative element according to this disclosure. FIG. 9B is a perspective cross-sectional view of an embodiment of an earring with a three piece decorative element in an open position (3-shape) according to this disclosure. As similarly explained above, an earring 300 includes a first arcuate segment 301, a second arcuate segment 304, and a pivot joining the first arcuate segment 301 and the second arcuate segment 304. The first arcuate segment 301 includes a first outer side, a first inner side 303, a first left side 327, and a first right side. The second arcuate segment 304 includes a second outer side 305, a second inner side 306, a second left side 329 and a second right side. The first left side 327 and the first right side extend from the first outer side or the first inner side 303, or the second left side 329 and the second right side from the second outer side 305 or the second inner side 306. For example, such forms of extension may include spanning between the first outer side and the first inner side 303 or the second outer side 305 and the second inner side 306.

Unlike FIGS. 1-8B, the pivot is embodied as a pair of horns 326 extending (e.g., monolithically) from the second arcuate segment 304 to mate with a corresponding depression, well, cavity, hole, bore, or indentation of the first arcuate segment 301 to enable the first arcuate segment 301 to move (e.g., rotate) relative to the second arcuate segment 304 between the first position (e.g., closed) and the second position (e.g., open) or the second arcuate segment 304 to move (e.g., rotate) relative to the first arcuate segment 301 between the third position (e.g., closed) and the fourth position (e.g., open), as disclosed herein. Similar to the earring 100 or the earring 200, such movement can be a free movement or an elastic movement (e.g., a spring) between the first position and the second position or the third position and the fourth position. Note that this configuration can be reversed with the horns 326 extending from the first arcuate segment 301 to mate with a corresponding depression, well, cavity, hole, bore, or indentation of the second arcuate segment 304 and such movement can be a free movement or an elastic movement (e.g., a spring) between the first position and the second position or the third position and the fourth position. Regardless, the first arcuate segment 301 and the second arcuate segment 304 collectively form the C-shape in the first position (e.g., closed) and the third position (e.g., closed) as shown in FIG. 5 when the earring 200 is closed. The horns 326 extend between the first inner side and the first wall 307, between the second inner side and the second wall 309, and the first inner side 303 and the third wall 311 when the earring 300 is in the first position (e.g., closed) and the third position (e.g., closed). The first arcuate segment 301 and the second arcuate segment 304 collectively form the 3-shape in the second position (e.g., open) and the fourth position (e.g., open) as shown in FIG. 7B when the earring 200 is open.

The earring 300 includes a first wall 307, a second wall 309, and a third wall 311. The first wall 307 includes a first peak 308 and is radially disposed on the first outer side such that the horns 326 extend between the first inner side 303 and the first wall 307. The second wall 309 includes a second peak 310 and is radially disposed on the second outer side 305 such that the horns 326 extend between the second inner side 306 and the second wall 309. The third wall 311 includes a third peak 314 and is radially disposed on the first outer side such that the horns 326 extend between the first inner side 303 and the third wall 311.

The first wall 307 can have a first optical property (e.g., color, reflectivity, luster), the second wall 309 can have a second optical property (e.g., color, reflectivity, luster), and the third wall 311 can have a third optical property (e.g., color, reflectivity, luster). The first optical property can be identical to the second optical property or the third optical property. For example, at least two of the first wall 307, the second wall 309, or the third wall 311 can collectively present a single optical appearance. The first optical property can be different from the second optical property or the third optical property. For example, at least two of the first wall 307, the second wall 309, or the third wall 311 can avoid collectively presenting a single optical appearance.

Each of the horns 326 has a cross-section that is circular, but this shaping can vary (e.g., polygonal, oval, triangular, pentagonal, hexagonal, square, rectangular, symmetrical, asymmetrical, open-shape, closed-shape) as long as the first arcuate segment 301 can move (e.g., rotate) about the horns 326 relative to the second arcuate segment 304 between the first position (e.g., closed) and the second position (e.g., open) or the second arcuate segment 301 can move (e.g., rotate) about the horns 326 relative to the first arcuate segment 301 between the third position (e.g., closed) and the fourth position (e.g., open). Each of the horns 326 has includes an outer surface that is smooth, but can be non-smooth (e.g., rough, textured, knurled, bumped, spiked, depressed, threaded) as long as the first arcuate segment 301 can move (e.g., rotate) about the horns 326 relative to the second arcuate segment 304 between the first position (e.g., closed) and the second position (e.g., open) or the second arcuate segment 301 can move (e.g., rotate) about the horns 326 relative to the first arcuate segment 301 between the third position (e.g., closed) and the fourth position (e.g., open). Each of the horns 326 is internally solid (e.g., a bar), but can be hollow (e.g., a cylinder) or compartmentalized (e.g., with a set of compartments). Each of the horns 326 includes a metal (e.g., gold, silver) or a metal alloy (e.g., steel), but can include other materials (e.g., plastic, rubber, wood, silicon). Each of the horns 326 is rigid (e.g., unable to be manually bent), but can be flexible (e.g., able to be manually bent). Each of the horns 326 is monolithic (e.g., a single unit including a same material, additively manufactured, 3-D printed, cast, injection molded), but can be an assembly of parts (e.g., by fastening, mating, interlocking).

As similarly explained above, the earring 300 includes a second decorative element 314, a third decorative element 315, a fourth decorative element 316, a fifth decorative element 317, a sixth decorative element 318, a seventh decorative element 319, an eighth decorative element 320, a ninth decorative element 321, and a tenth decorative element 322, a set of prongs 323, and a post or bridge 324.

However in other embodiments, the earring 300 can have more of such decorative elements or less of such decorative elements or other decorative elements, and as such can have any suitable number of decorative elements, whether decoratively identical or non-identical to each other. These decorative elements can collectively form a sequential decorative pattern (e.g., arcuately disposed), as shown in FIG. 9A, to visually blend with a decorative element defined by the first wall 307, the second wall 309, and the third wall 311, as similarly explained above, such that the decorative element is not readily visually distinguishable from other decorative elements forming the sequential decorative pattern when the decorative element is included in the sequential decorative pattern among other decorative elements in the sequential decorative pattern, whether being interposed between two decorative elements or being an ending decorative element in the sequential decorative pattern. Note that other decorative patterns may be formed (e.g., a geometrical pattern, a linear pattern, a rectilinear pattern, a sinusoidal pattern, a zigzag pattern, a polygonal pattern, an oval pattern, a circular pattern, a closed-shape pattern, an open-shape pattern, a character pattern, a star pattern, an animal pattern, a natural phenomenon pattern, a planetary pattern), whether additionally or alternatively, whether alone, integrated with, parallel, or intersecting with other decorative patterns.

As similarly explained above, the decorative element is at least generally pyramidal in shape. Although depicted as a four-sided pyramid, other configurations are possible, such as a three-sided pyramid. Additionally, the decorative element can have other shapes, including, but not limited to, generally domed, generally semi-circular, generally square or rectangular, or generally parabolic, and can be symmetrical or asymmetrical, along a single plane or multiple planes. As shown in FIG. 9A, the additional decorative elements (the second decorative element 214, the third decorative element 215, the fourth decorative element 216, the fifth decorative element 217, the sixth decorative element 218, the seventh decorative element 219, the eighth decorative element 220, the ninth decorative element 221, and the tenth decorative element 222) are at least generally conical in shape to allow for visual blending with the decorative element, as explained herein, although again these decorative elements can have other shapes, including, but not limited to, generally domed, circular, generally semi-circular, generally triangular, generally pyramidal, generally square or rectangular, or generally parabolic. Although as shown in FIG. 9A, the additional decorative elements (the second decorative element 214, the third decorative element 215, the fourth decorative element 216, the fifth decorative element 217, the sixth decorative element 218, the seventh decorative element 219, the eighth decorative element 220, the ninth decorative element 221, and the tenth decorative element 222) have a similar or identical shape, in other embodiments different decorative elements can have different shapes to allow for visual blending with the decorative element 111, as explained herein. In various embodiments, the decorative elements can be at least partially or totally a gemstone, either precious or semi-precious, stone, glass, metal, plastic, wood, or a bead, or any combination thereof. For example, the gemstone can include diamond, ruby, sapphire, opal, moissanite, lapis, quartz, emerald, amethyst, turquoise, amber, ivory, bone, coral, or other suitable gemstones. Although the additional decorative elements in FIG. 9A are shown in a single row, in other embodiments, the additional decorative elements can be in multiple rows, for example two rows, three rows, four rows five rows, six rows, or more, and additionally the additional decorative elements do not have to be aligned with each other, but can be offset in certain embodiments. The prongs 323 that hold the additional decorative elements in place. The prongs 323 can take on any configuration as long as the additional decorative elements remain in place. The prongs 323 can be metal (e.g., gold, silver) or a metal alloy (e.g., steel), or can be manufactured from other materials (e.g., plastic, rubber, wood, silicon), or any combination thereof. As similarly explained above, although FIG. 9A shows the earring 300, in other embodiments, any number of different types or pieces of jewelry, including, but not limited to, a bracelet, an anklet, a belt, a necklace, a ring worn on a finger, thumb, or toe, or a ring worn in the belly button or nose, or other suitable jewelry items or devices may be used. Although the earring 300 shown in FIG. 9A is generally circular, in other embodiments, this disclosure enables for jewelry to have any shape that can adopt a generally closed configuration, including, but not limited to, oval, triangular, square, rectangular, pentagonal, hexagonal, heptagonal, octagonal, nonagonal, decagonal, polygonal, or other suitable closed or open shapes.

As similarly explained above, FIG. 9A depicts the first inner side 303, the first outer side, the first left side 327, and the first right side of the first arcuate segment 301, and the second outer side 305, the second inner side 306, the second left side 329 and the second right side of the second arcuate segment 304 as smooth, but in other embodiments, these sides can also be non-smooth (e.g., rough, textured, knurled, bumped, spiked, depressed, threaded), a combination of smooth and non-smooth, or certain sides can be smooth and other sides be non-smooth. The first arcuate segment 301 and the second arcuate segment 304 can be internally solid (e.g., a bar), but can also be hollow (e.g., a cylinder) or compartmentalized (e.g., with a set of compartments). The first arcuate segment 301 and the second arcuate segment 304 can include a metal (e.g., gold, silver) or a metal alloy (e.g., steel), can include other materials (e.g., plastic, rubber, wood, silicon), or any combination thereof. The first arcuate segment 301 and the second arcuate segment 304 can be rigid (e.g., unable to be manually bent), but can also be flexible (e.g., able to be manually bent), or a combination of rigid and flexible portions. The first arcuate segment 301 and the second arcuate segment 304 can each be monolithic (e.g., a single unit including a same material, additively manufactured, 3-D printed, cast, injection molded), but can also be an assembly of parts (e.g., by fastening, mating, interlocking).

Also similarly explained above, the post or bridge 324 can extend through a portion of the ear of the wearer. For example, the portion of the ear can include an earlobe (lobule), a helix, a concha, a superior concha, a crus, a superior crus, an antitragus, an antihelix, a scapha, a triangular fossa, a concha cymba, a tragus, or other suitable portions of the ear. The post or bridge 324 can extend longitudinally from, or be connected to or extend into the first arcuate segment 301 or the second arcuate segment 304. Although the post or bridge 324 is shown in FIG. 9A as generally longitudinally extending as an arc that is curved along the space. Although the post or bridge 324 is shown in FIG. 9A as generally longitudinally extending as an arc that is curved along a space defined via the first inner side 303 and the second inner side 306 within the earring 300 when the earring 300 is closed (the first position or the third position), in other embodiments, the post or bridge 324 can be essentially longitudinally rectilinear over the space defined via the first inner side 303 and the second inner side 306 within the earring 300 when the earring 300 is closed (the first position or the third position), but can also be essentially non-rectilinear (e.g., U-shape, C-shape, V-shape, helical, sinusoidal, or arcuate), whether concave or convex, over the space defined via the first inner side 103 and the second inner side 106 within the earring 100 when the earring 100 is closed (the first position or the third position). The post or bridge 324 has a cross-section that is circular, but this shaping can vary (e.g., polygonal, oval, triangular, pentagonal, hexagonal, square, rectangular, symmetrical, asymmetrical, open-shape, closed-shape). The post or bridge 324 includes an outer surface that is smooth, but can be non-smooth (e.g., rough, textured, knurled, bumped, spiked, depressed, threaded). The post or bridge 324 is internally solid (e.g., a bar), but can be hollow (e.g., a cylinder) or compartmentalized (e.g., with a set of compartments). The post or bridge 324 includes a metal (e.g., gold, silver, copper) or a metal alloy (e.g., steel), but can include other materials (e.g., plastic, rubber, wood, silicon). The post or bridge 324 is rigid (e.g., unable to be manually bent), but can be flexible (e.g., able to be manually bent). The post bridge 324 is monolithic (e.g., a single unit including a same material, additively manufactured, 3-D printed, cast, injection molded), but can be an assembly of parts (e.g., by fastening, mating, interlocking).

As explained above, these configurations are technologically beneficial in various scenarios. For example, when the piece of jewelry is an earring, then, in showcasing the earring, either physically, such as in a physical store, enables a potential customer to avoid bending down to more closely examine the earring, or virtually, such as in an electronic shopping platform, enables a viewer of an image of the earring to avoid having the image being expanded or zoomed in for a closer view. Additionally, the visually continuous appearance may avoid being aesthetically displeasing to a wearer of the earring. Furthermore, when the earring with the hinge region is being manufactured, the hinge region may avoid being skipped over to deposit the decorative elements, thereby minimizing delaying or slowing down the earring in being manufactured. Likewise, a jeweler is now enabled to design the earring to have the decorative element in the region to have two or more distinct optical properties (e.g., reflectivity, luster) when the first wall and the second wall have distinct optical properties (e.g., optically different from each other in color, reflectivity, luster). Similar technological benefits apply when the piece of jewelry is a bracelet, an anklet, a charm, a pendant, a bracelet, or another suitable piece of jewelry or device.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated. This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. A device comprising:

a first arcuate segment having a first outer side and a first inner side;

a second arcuate segment having a second outer side and a second inner side;

a pivot joining the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position;

a first wall radially disposed on the first outer side such that the pivot extends between the first inner side and the first wall, wherein the first wall includes a first peak;

a second wall radially disposed on the second outer side such that the pivot extends between the second inner side and the second wall, wherein the second wall includes a second peak, wherein the first wall and the second wall oppose each other when the first peak and the second peak are coaligned with each other in the first position and the third position such that the first wall and the second wall collectively form a decorative element, wherein the first wall is offset with the second wall when the first peak and the second peak are not coaligned with each other in the second position and the fourth position such that the first wall and the second wall do not collectively form the decorative element;

a first gemstone disposed on the first outer side; and a second gemstone disposed on the second outer side, wherein the decorative element is disposed between the first gemstone and the second gemstone in the first position and the third position such that the first gemstone, the decorative element, and the second gemstone collectively form a decorative pattern along the first outer side and the second outer side in the first position and the third position.

2. The device of claim 1, wherein the decorative element has a conical shape in the first position and the third position.

3. The device of claim 1, wherein the decorative pattern is linear.

4. The device of claim 1, wherein the decorative element has a dome shape in the first position and the third position.

5. The device of claim 1, wherein the first arcuate segment and the second arcuate segment at least partially define a bracelet.

6. The device of claim 1, wherein the first arcuate segment and the second arcuate segment at least partially define a charm or a pendant.

7. The device of claim 1, wherein the pivot includes a horn spanning between the first arcuate segment and the second arcuate segment, wherein the horn extends outwardly.

8. The device of claim 1, wherein the first wall is a third gemstone and the second wall is a fourth gemstone.

9. The device of claim 1, wherein the decorative element has a pyramidal shape in the first position and the third position.

10. The device of claim 9, wherein the pyramidal shape is a three-sided pyramid in the first position and the third position.

11. The device of claim 9, wherein the pyramidal shape is a four-sided pyramid in the first position and the third position.

12. The device of claim 9, wherein each of the first gemstone and the second gemstone has a conical shape.

13. The device of claim 1, wherein the first arcuate segment and the second arcuate segment at least partially define an earring.

14. The device of claim 1, further comprising:

a third wall radially disposed on the first outer side such that the pivot extends between the first inner side and the third wall, wherein the third wall includes a third peak, and wherein the second wall is interposed between the first wall and the third wall when the first peak, the second peak, and the third peak are coaligned with each other in the first position and the third position such that the first wall, the second wall, and the third wall further collectively form the decorative element, wherein the third wall is offset with the second wall when the third peak and the second peak are not coaligned with each other in the second position and the fourth position such that the third wall or the first wall and the second wall do not further collectively form the decorative element.

15. The device of claim 14, wherein the decorative element has a pyramidal shape in the first position and the third position.

16. The device of claim 1, wherein the pivot is a pin engaging the first arcuate segment and the second arcuate segment.

17. The device of claim 1, wherein the pivot includes a horn spanning between the first arcuate segment and the second arcuate segment, wherein the horn extends inwardly.

18. The device of claim 1, wherein the first arcuate segment includes a first material, wherein the second arcuate segment includes a second material, wherein the decorative element includes a third material, wherein the third material is different from at least one of the first material or the second material.

19. The device of claim 18, wherein the first material and the second material are one material.

20. The device of claim 1, wherein the first wall has a first optical property and the second wall has a second optical property, wherein the first optical property is identical to the second optical property.

21. The device of claim 1, wherein the first wall has a first optical property and the second wall has a second optical property, wherein the first optical property is not identical to the second optical property.

22. A method comprising:

accessing a device including a first arcuate segment, a second arcuate segment, a pivot, a first gemstone, a second gemstone, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak, wherein the first gemstone is disposed on the first outer side, wherein the second gemstone is disposed on the second outer side;

opening the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form a decorative element; and closing the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form the decorative element, wherein the decorative element is disposed between the first gemstone and the second gemstone in the first position and the third position such that the first gemstone, the decorative element, and the second gemstone collectively form a decorative pattern along the first outer side and the second outer side in the first position and the third position.

23. A method comprising:

accessing a device including a first arcuate segment, a second arcuate segment, a pivot, a first gemstone, a second gemstone, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak, wherein the first gemstone is disposed on the first outer side, wherein the second gemstone is disposed on the second outer side;

closing the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form a decorative element, wherein the decorative element is disposed between the first gemstone and the second gemstone in the first position and the third position such that the first gemstone, the decorative element, and the second gemstone collectively form a decorative pattern along the first outer side and the second outer side in the first position and the third position; and opening the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form the decorative element.

24. A method comprising:

supplying a device to an end user, wherein the device includes a first arcuate segment, a second arcuate segment, a pivot, a first gemstone, a second gemstone, a first wall, and a second wall, wherein the first arcuate segment having a first outer side and a first inner side, wherein the second arcuate segment having a second outer side and a second inner side, wherein the pivot joins the first arcuate segment and the second arcuate segment such that the first arcuate segment is configured to move about the pivot relative to the second arcuate segment between a first position and a second position or the second arcuate segment is configured to move about the pivot relative to the first arcuate segment between a third position and a fourth position, wherein the first wall is radially disposed on the first outer side such that the pivot extends between the first inner side and the first wall, wherein the first wall includes a first peak, wherein the second wall is radially disposed on the second outer side such that the pivot extends between the second inner side and the second wall, wherein the second wall includes a second peak, wherein the first gemstone is disposed on the first outer side, wherein the second gemstone is disposed on the second outer side; and instructing the end user to:

open the device based on moving the first arcuate segment about the pivot relative to the second arcuate segment from the first position to the second position or the second arcuate segment about the pivot relative to the first arcuate segment from the third position to the fourth position such that the first wall is offset with the second wall when the first peak and the second peak are not coaligned with each other in the second position and the fourth position such that the first wall and the second wall do not collectively form a decorative element; and close the device based on moving the first arcuate segment about the pivot relative to the second arcuate segment from the second position to the first position or the second arcuate segment about the pivot relative to the first arcuate segment from the fourth position to the third position such that the first wall and the second wall oppose each other when the first peak and the second peak are coaligned with each other in the first position and the third position such that the first wall and the second wall collectively form the decorative element, wherein the decorative element is disposed between the first gemstone and the second gemstone in the first position and the third position such that the first gemstone, the decorative element, and the second gemstone collectively form a decorative pattern along the first outer side and the second outer side in the first position and the third position.

* * * * *